US008434835B2

(12) United States Patent
Hardy et al.

(10) Patent No.: US 8,434,835 B2
(45) Date of Patent: May 7, 2013

(54) WALL MOUNTING SYSTEM FOR MOVABLY MOUNTING MODULAR INSTITUTIONAL FURNITURE AND FIXTURES

(75) Inventors: Craig A. Hardy, Hart, MI (US); Randall J. Seaver, Hart, MI (US)

(73) Assignee: Silver Street, Inc., Shelby, MI (US)

( * ) Notice: Subject to any disclaimer, the term of this patent is extended or adjusted under 35 U.S.C. 154(b) by 362 days.

(21) Appl. No.: 12/987,511

(22) Filed: Jan. 10, 2011

(65) Prior Publication Data

US 2011/0169386 A1 Jul. 14, 2011

Related U.S. Application Data

(60) Provisional application No. 61/293,375, filed on Jan. 8, 2010.

(51) Int. Cl.
*A47B 96/06* (2006.01)

(52) U.S. Cl.
USPC ..... 312/245; 211/94.01

(58) Field of Classification Search ..... 312/245, 312/246, 107, 108; 108/48, 152; 52/36.6, 52/836, 843, 846; 248/205.1, 298.1, 429, 248/235; 211/94.01
See application file for complete search history.

(56) References Cited

U.S. PATENT DOCUMENTS

| | | | | | |
|---|---|---|---|---|---|
| 111,384 | A | * | 1/1871 | Root | 248/235 |
| 1,745,402 | A | | 2/1930 | Buick | |
| 2,499,240 | A | | 2/1950 | Aiken | |
| 3,290,846 | A | | 12/1966 | Mader | |
| 3,778,939 | A | | 12/1973 | Nelsson | |
| 4,083,157 | A | | 4/1978 | Anthonioz | |
| 4,180,298 | A | | 12/1979 | Borgerson, Jr. | |
| 4,457,436 | A | * | 7/1984 | Kelley | 211/88.01 |
| 4,459,790 | A | | 7/1984 | Vermillion | |
| 4,618,192 | A | * | 10/1986 | Kelley | 312/245 |
| 4,716,699 | A | | 1/1988 | Crossman et al. | |
| 4,809,479 | A | * | 3/1989 | Tierno et al. | 52/588.1 |
| 4,843,977 | A | * | 7/1989 | Bridges | 108/152 |
| 4,876,835 | A | | 10/1989 | Kelley et al. | |
| 4,907,384 | A | | 3/1990 | Underwood | |
| 4,942,498 | A | * | 7/1990 | Toussaint | 361/709 |
| 4,944,122 | A | | 7/1990 | Wendt | |
| 5,010,702 | A | | 4/1991 | Daw et al. | |
| 5,309,686 | A | | 5/1994 | Underwood et al. | |
| 5,697,507 | A | * | 12/1997 | Blass | 211/94.01 |
| 5,718,493 | A | * | 2/1998 | Nikolai | 312/245 |
| 6,113,201 | A | * | 9/2000 | Bauer | 312/245 |
| 6,811,043 | B2 | * | 11/2004 | Perkins et al. | 211/94.01 |

(Continued)

*Primary Examiner* — Janet M Wilkens
(74) *Attorney, Agent, or Firm* — John A. Waters; Waters & Associates PLC

(57) ABSTRACT

A modular mounting system for institutional or classroom furniture or fixtures includes mounting rails that are attached to a wall surface in a horizontal orientation and that are vertically spaced. The mounting rails have a flat wall-mounting portion, with upper and lower T-shaped sections projecting therefrom, forming upper and lower U-channels and a central C-channel. The wall-mounting portion has a lower chamfered edge. Sections of mounting rail are aligned by a spline inserted into the C-channel. The system is infinitely adaptable to a wide range of changing uses for the classroom, with each element of the modular classroom furniture easily mounted to or removed from the mounting rail with only a screwdriver. The selectable elements include a flat panel accessory that rides between the upper and lower mounting rails, an accessory tray, and vertical rail members and casegoods in various configurations that attach to one or both rails.

20 Claims, 30 Drawing Sheets

U.S. PATENT DOCUMENTS 7,104,023 B1 * 9/2006 Holztrager ..... 52/705
D551,470 S * 9/2007 Loew ..... D6/491
7,296,695 B2 * 11/2007 Perkins et al. ..... 211/94.01
8,177,079 B2 * 5/2012 Schwartzkopf et al. ..... 211/103
8,177,311 B2 * 5/2012 Apgood et al. ..... 312/245
8,376,299 B2 * 2/2013 Burkman ..... 248/235
2005/0029210 A1 * 2/2005 Perkins et al. ..... 211/94.01
2010/0308702 A1 * 12/2010 Apgood et al. ..... 312/245

* cited by examiner

WALL MOUNTING SYSTEM FOR MOVABLY MOUNTING MODULAR INSTITUTIONAL FURNITURE AND FIXTURES

CROSS-REFERENCE TO RELATED APPLICATIONS

The present application is based on and claims the filing priority of Applicant's U.S. Provisional Patent Application No. 61/293,375, filed Jan. 8, 2010, and entitled WALL MOUNTING SYSTEM FOR MOVABLY MOUNTING MODULAR INSTITUTIONAL FURNITURE AND FIXTURES, the disclosure of which is incorporated by reference.

STATEMENT REGARDING FEDERALLY SPONSORED RESEARCH OR DEVELOPMENT

Not Applicable.

PARTIES TO A JOINT RESEARCH AGREEMENT

Not Applicable.

FIELD OF THE INVENTION

The invention relates to adaptable interior furnishings, and more specifically to a wall mounting system for movably mounting modular furniture and fixtures for classrooms, offices and hospitals.

BACKGROUND OF THE INVENTION

The construction and furnishing of institutional facilities, particularly in the public sector, often requires a long lead time due to the requirement to compete for limited funds among changing public priorities. This often results in a delay between initial design of a facility and the actual construction phase. During this delay, design and use criteria can change. This change in criteria can result in unanticipated changes in the layout and use of portions of a facility, changes that might require structural modifications or the disposal and repurchasing of installed case goods and other furniture components that no longer meet the changed standards or intended use. Further, once a facility is made operational, even valid use criteria at the time of opening may change in the following years, requiring future modification of the furniture and furniture layout in the building. Structural modification of permanent, wall mounted case goods and other fixtures are especially expensive and disruptive of the continuing operation of the facility.

It would be advantageous to provide a means of readily modifying the arrangement and components of case goods and other wall mounted fixtures in building areas. It would be particularly advantageous if the means of modifying the building areas required no structural modification of the facility.

DETAILED DESCRIPTION OF THE INVENTION

Figure 1A:
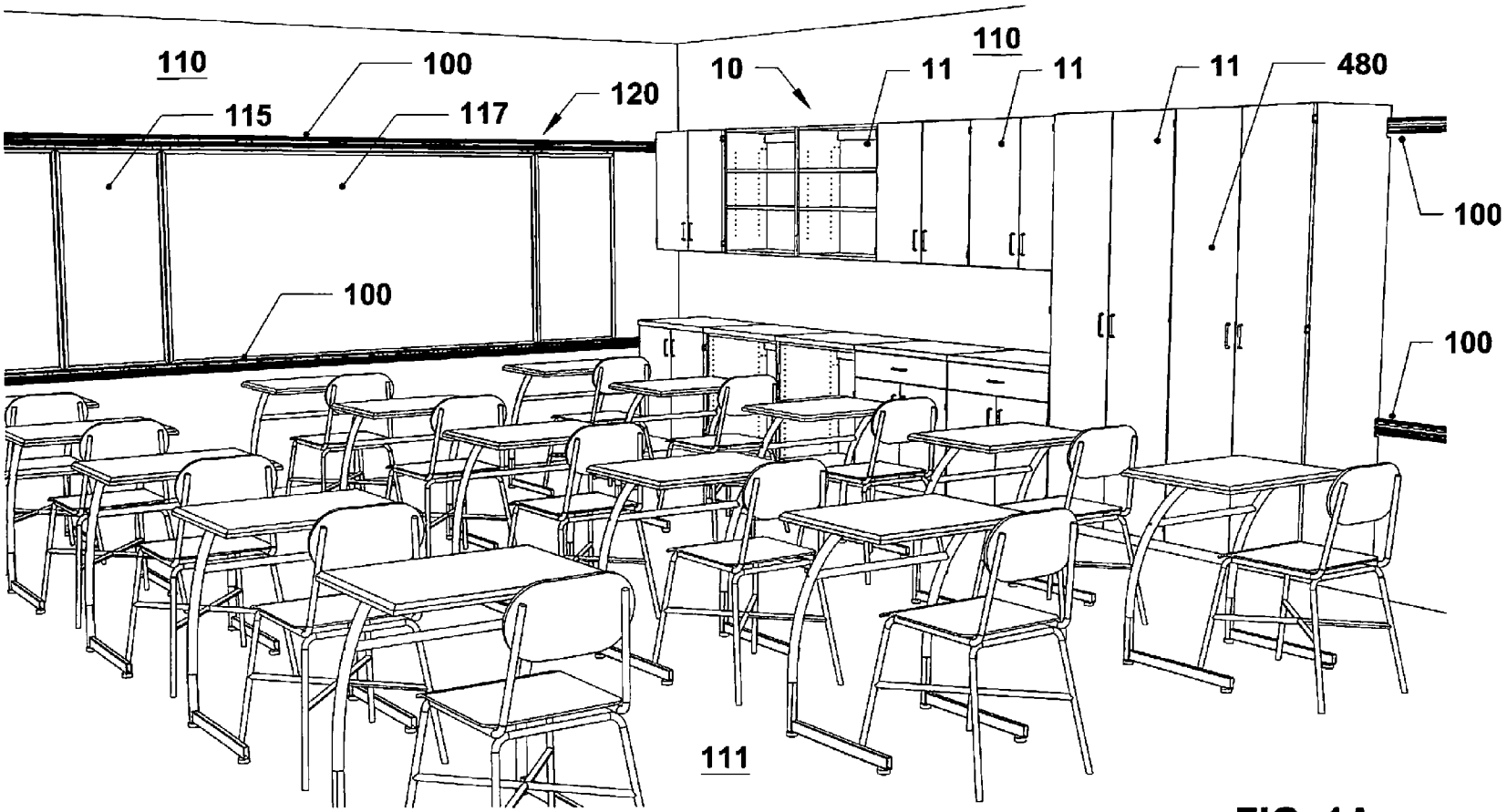
FIGS. 1A and 1B are perspective views of wall mounting systems for modular institutional furniture and fixtures according to the present invention, installed in two different classroom settings.
Figure 1B:
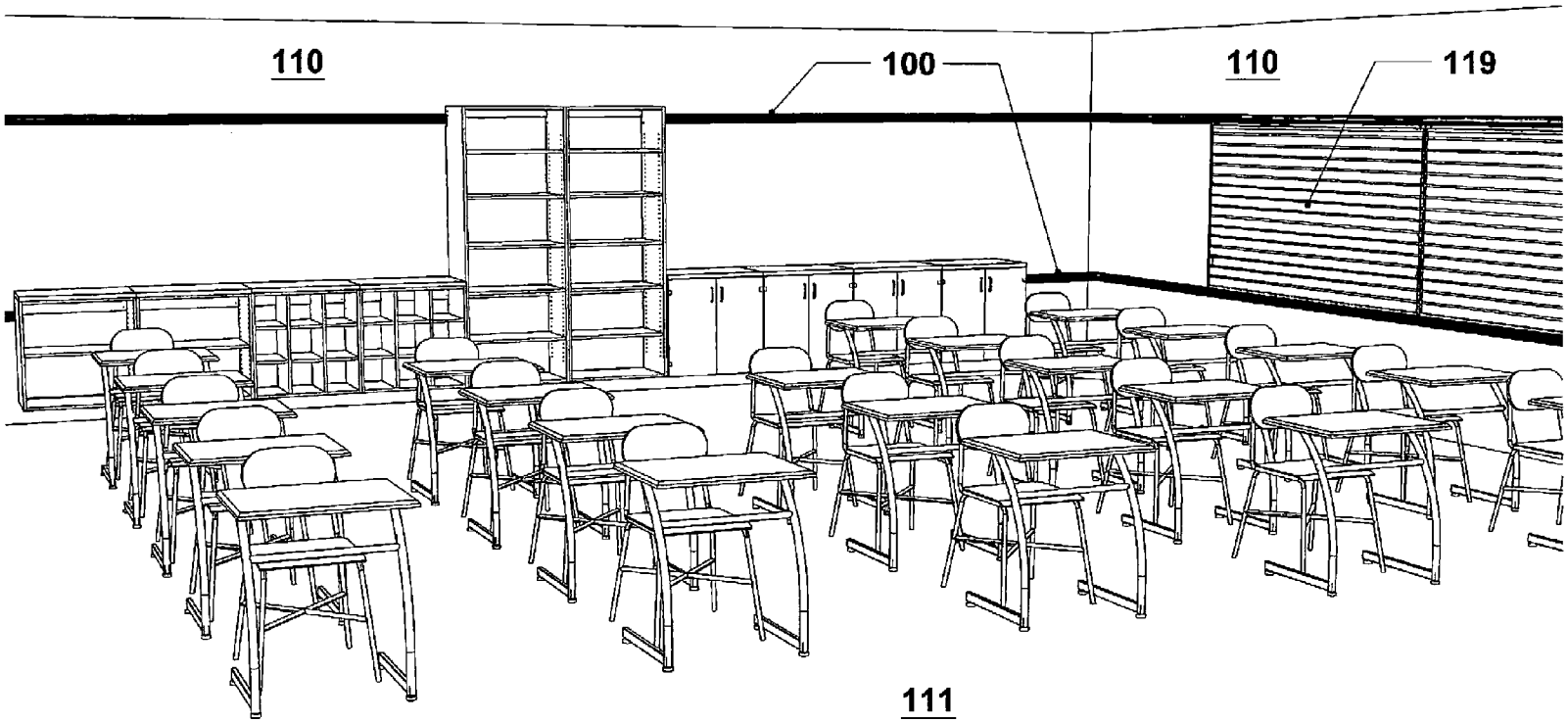
Figure 2:
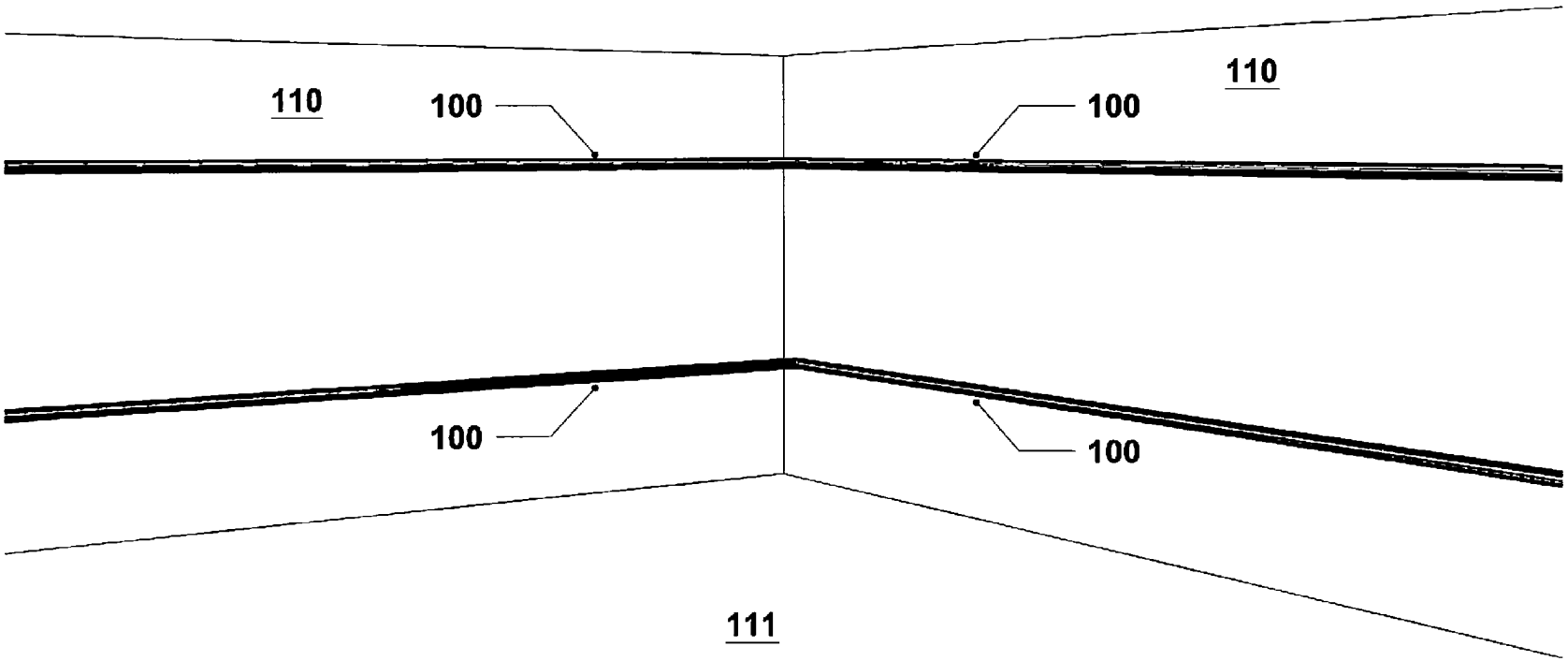
FIG. 2 is a perspective view of an installed mounting rail of the mounting system of FIG. 1.

A modular classroom furniture system 10, shown in FIG. 1, includes a number of wall mounted furniture and fixture elements 11 mounted on one or both of a pair of vertically spaced horizontal mounting rails 100 secured to the usable vertical wall surfaces 110 of a classroom 111. The mounting rails 100 are secured at pre-determined heights and spacing to accommodate the accessories or modules mounted to one or both rails. The modules can include panel members such as tackboards 115 or marker boards 117 or blackboards or other planar display members, such as slatwall 119 (all referred to hereinafter as movable panels 120). A complementary accessory tray or chalk/marker tray 125 (FIG. A) can be independently mounted on the rail 100 below a marker board or the like. Vertical standards or pilasters 130 (FIG. 4) for accommodating shelves or hanging implements can be suspended between the rails or can extend downwardly from the lower rail toward the floor. A full complement of modular cabinetry 135 that can be readily replaced or rearranged to meet the evolving needs of the user can be suspended from or between the rails. Cable or wire management channels 140 (FIG. 11) can be mounted along the mounting rails 100 for protective integrated wire management and convenient servicing of electrical or electronic equipment employed in the modular classroom furniture system 10.

Figure 3:
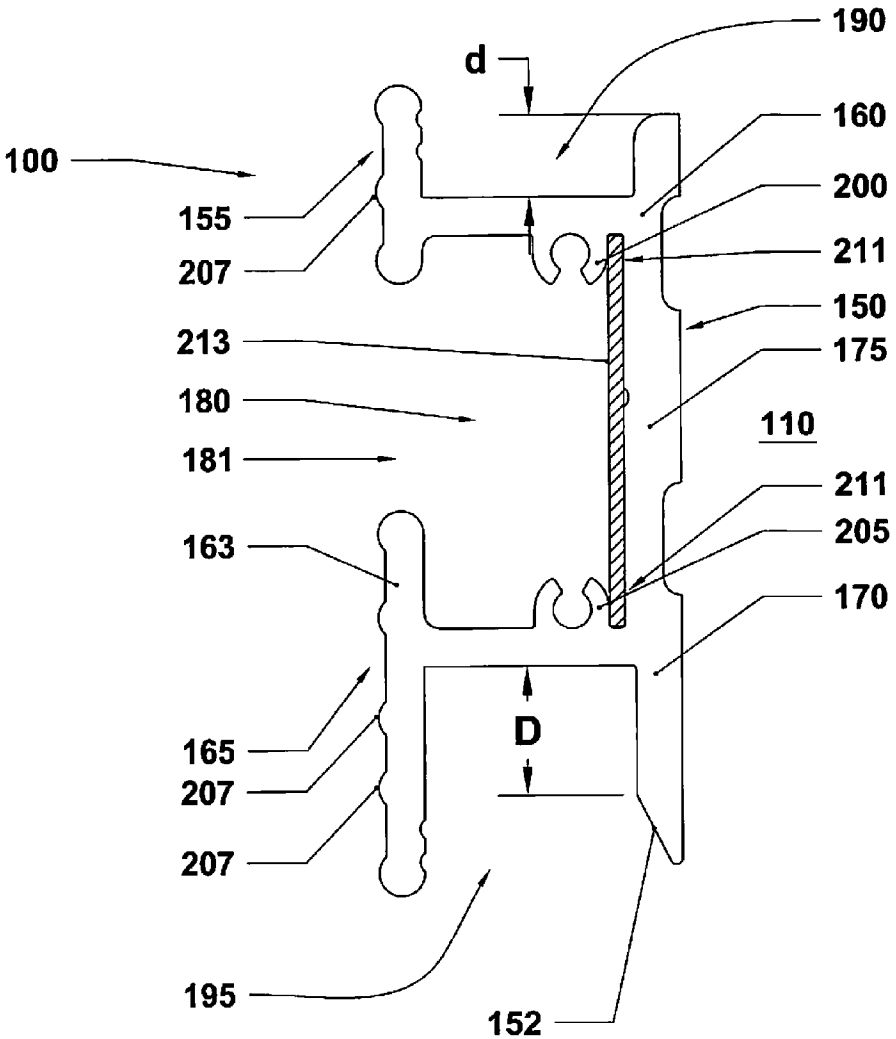
FIG. 3 is a cross-sectional view of the mounting rail of FIGS. 1-2.

Referring to FIG. 3, the mounting rail 100 includes a planar wall-mount panel section 150 that is adapted to be mounted directly to the support surface 110 by screws or the like. The bottom edge 152 of the planar wall-mount section is downwardly and outwardly chamfered. An upper T-section 155 extends perpendicularly from an upper portion 160 of the planar wall-mount section. A lower T-section 165 extends perpendicularly from a lower portion 170 of the planar wall-mount section 150. The T-sections 155,165 combine with the central portion 175 of the planar wall-mount section 150, positioned between the upper and lower T-sections, to form a central C-shaped channel 180. The upper T-section and the upper portion 160 of the wall-mount section 150 form an upwardly disposed U-channel 190 having a depth d. The lower T-section 165 and the lower portion 170 of the wall-mount section 150 form a downwardly disposed U-channel 195 having a depth D. Within the C-shaped channel 180, trim channels 200,205 project inwardly from the upper and lower T-sections 155,165 into the C-shaped channel 180 and extend the length of the mounting rail 100.

Figure 5:
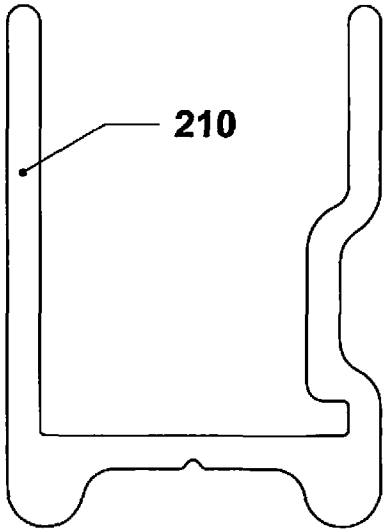
FIG. 5 is a cross-sectional view of a U-channel marker board frame member of the present invention.
Figure 6:
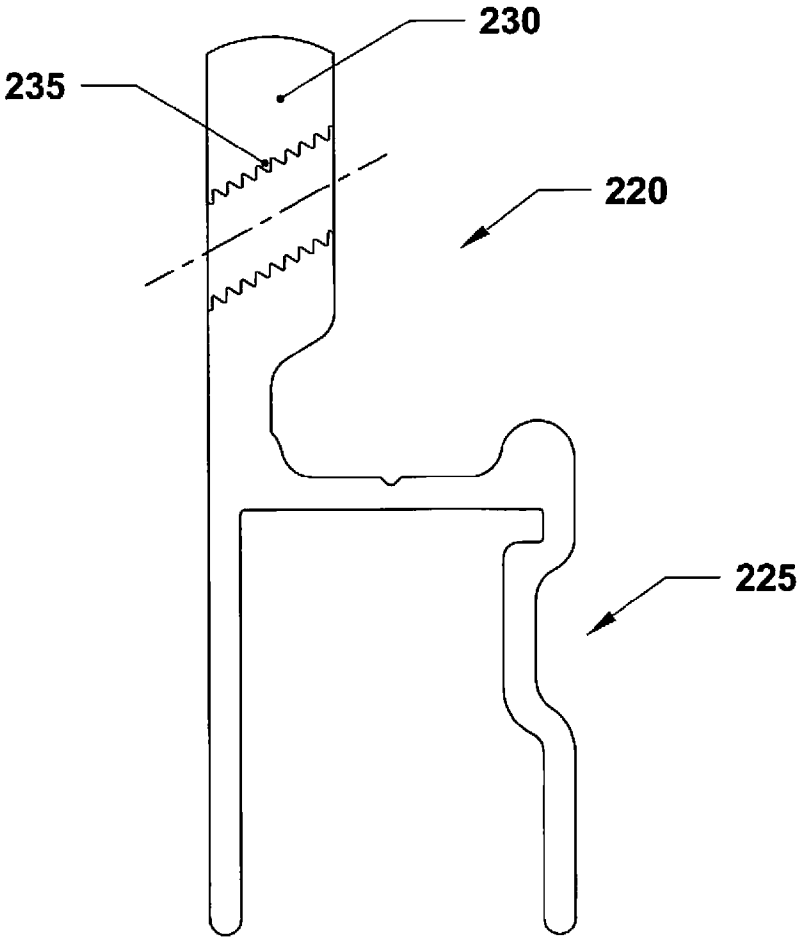
FIG. 6 is a cross-sectional view of an h-channel frame member for the upper edge of a marker board frame.
Figure 7:
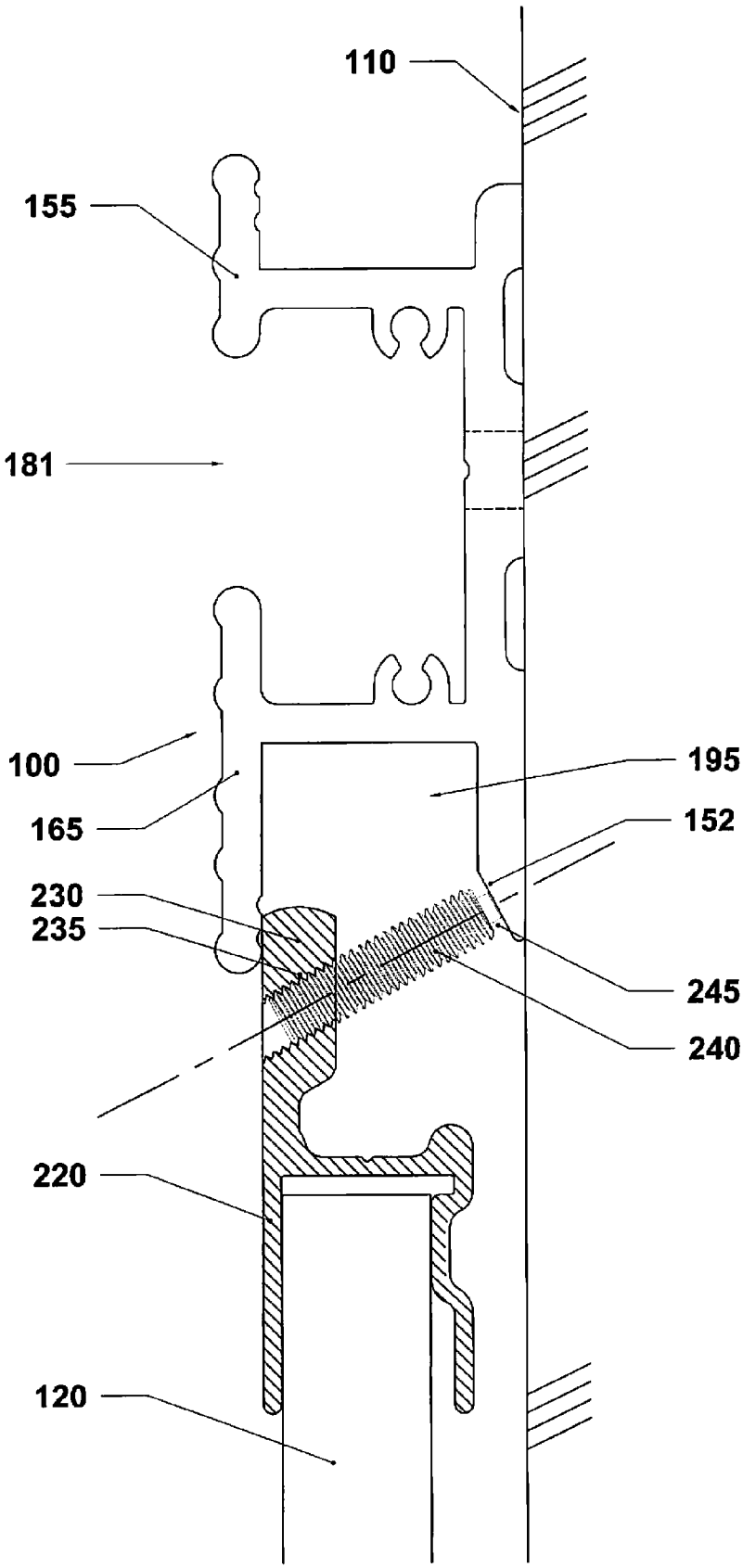
FIG. 7 is a cross-sectional view showing the h-channel frame member of a marker board attached to a mounting rail of the embodiment of FIGS. 1-6.

The movable panels 120 are bounded on three sides (bottom and two lateral sides) by frame members formed in the shape of U-channel 210 (FIG. 5). The top boundary of the movable panel 120 is defined by a frame member formed in the shape of "h"-channel 220 (FIG. 6) having a downwardly directed U-channel portion 225 and an upwardly extending flange 230 on a front edge. A threaded aperture 235 is provided in the upwardly extending flange 230, passing through the flange 230 at an upward inclination. A set screw 240 (FIG. 7) is provided for insertion through the threaded aperture 235. Referring to FIG. 7, the inclination of the aperture 235 is such that the set screw 240 engages the chamfered bottom edge 152 of the planar wall-mount section of the rail 100. The end 245 of the set screw 240 is formed of a non-hardened or non-marring material, such as nylon, that will not damage the face of the aluminum rail 100.

The movable wall panel 120 is inserted between parallel sections of the rail 100 in the following manner. The set screw 240 must be backed out so that it cannot contact the bottom edge 152 of the wall-mount planar section as the wall panel 120 is inserted into the rail 100. The panel 120 is then tilted so that the upper edge of the panel is inclined toward the support surface 110, and aligned so that the upwardly extending flange 230 of the top boundary channel 220 can pass beneath the lower T-shaped rail 165 and under the downwardly disposed U-channel 195. The panel 120 is then lifted so that the upwardly extending flange 230 rises into the downwardly disposed U-channel 195 of the upper mounting rail 100. The bottom of the panel 120 is then rotated inwardly toward the vertical wall surface 110 until it is aligned over the upwardly disposed U-channel 190 of the lower mounting rail 100. The panel 120 is then lowered until the bottom of the panel 120 rests in the upwardly disposed U-channel 190 of the lower mounting rail 100. The upwardly disposed U-channel 190 is sufficiently shallower than the downwardly disposed U-channel 195 of the upper mounting rail 100 such that, with the panel 120 resting in the upwardly disposed U-channel 190 of the lower mounting rail 100, the flange 230 extending from the upper edge of the panel 120 remains within the downwardly disposed U-channel 195 of the upper mounting rail 100. The panel 120 is free to slide laterally while resting in the upwardly disposed U-channel 190 of the lower rail 100.

It is generally desirable to prevent the panel 120 from being inadvertently dislodged from between the upper and lower rails 100. To prevent dislodging, the set screw 240 is extended toward the bottom chamfered edge 152 of the wall-mount section 150 until the non-marring tip 245 of the set screw 240 just contacts the chamfered edge 152. With minimal contact, the wall panel 120 can still be moved laterally between the mounting rails 100. If it is desirable to fix the lateral position of the panel 120, the set screw 240 can be further extended into firmer contact with the chamfered edge 152 to fix the panel 120 in place. In order to prevent the panel 120 from being tilted at one or the other of the lateral sides, at least two set screws should be provided in the upwardly extending flange 230, proximate to each of the lateral sides of the panel 120.

Figure 8A:
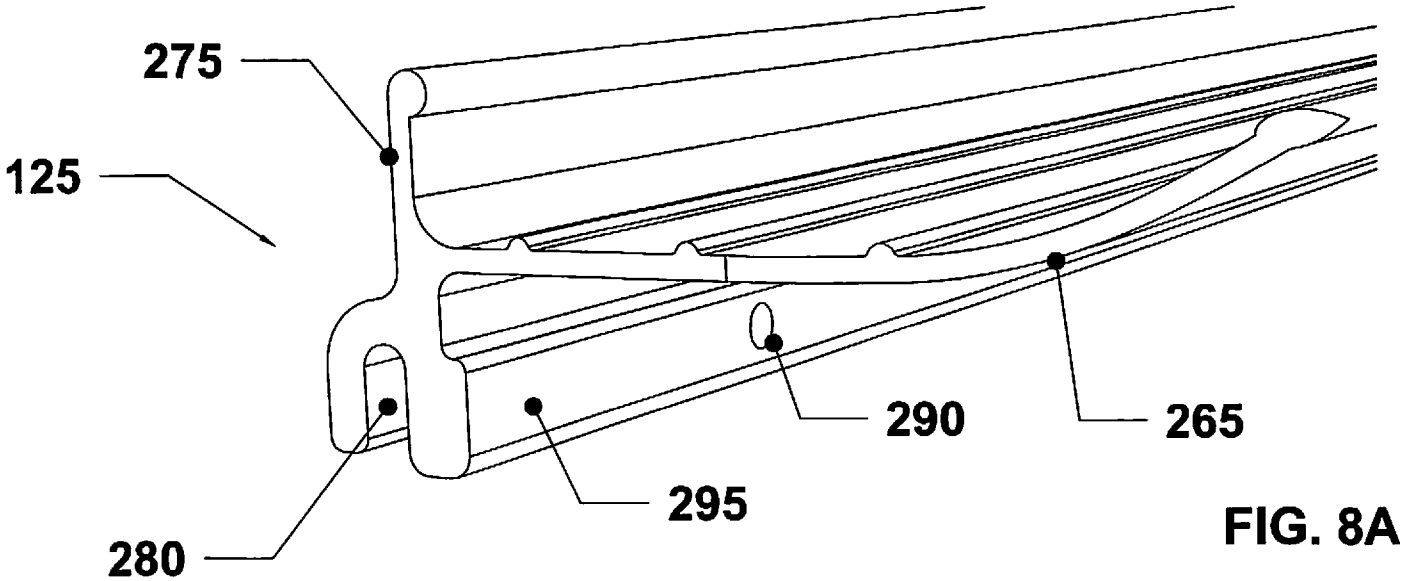
FIGS. 8A and 8B are perspective views and a cross-sectional view, respectively, of a chalk/marker or accessory tray employed with the marker board of FIGS. 1 and 4.
Figure 8B:
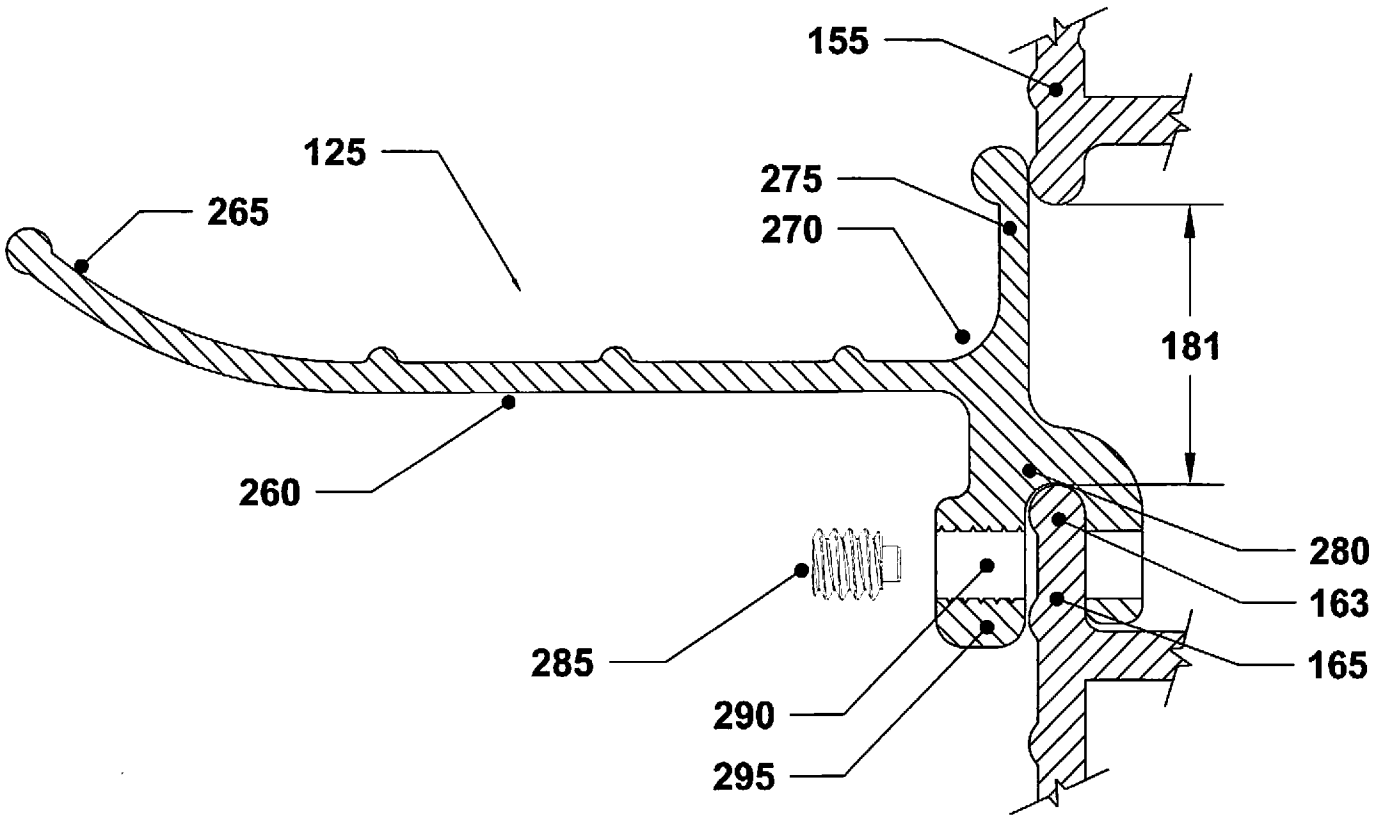
Figure 9A:
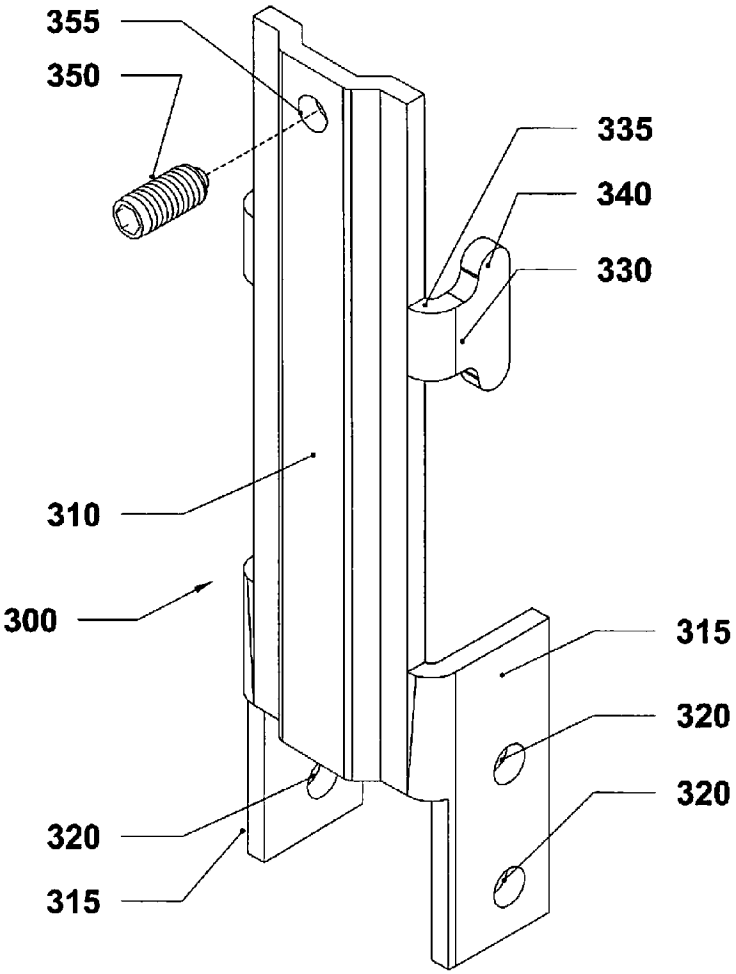
FIGS. 9A-9D are a perspective view, side and front elevational views, and a plan view of a vertical standard or pilaster attachment bracket of the present invention.
Figure 9B:
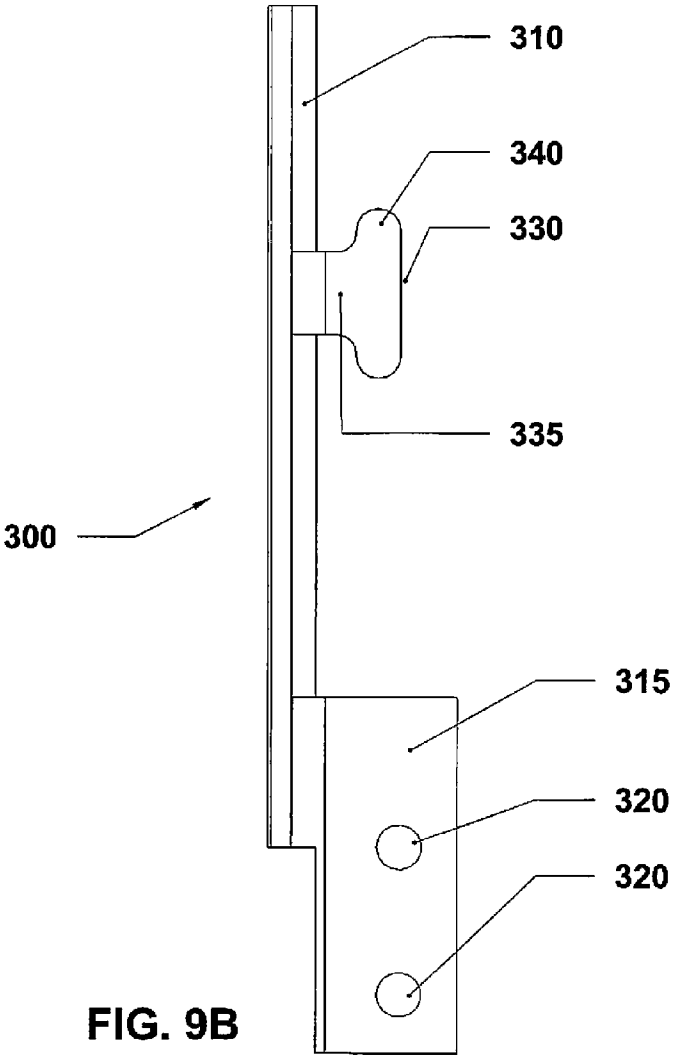
Figure 9C:
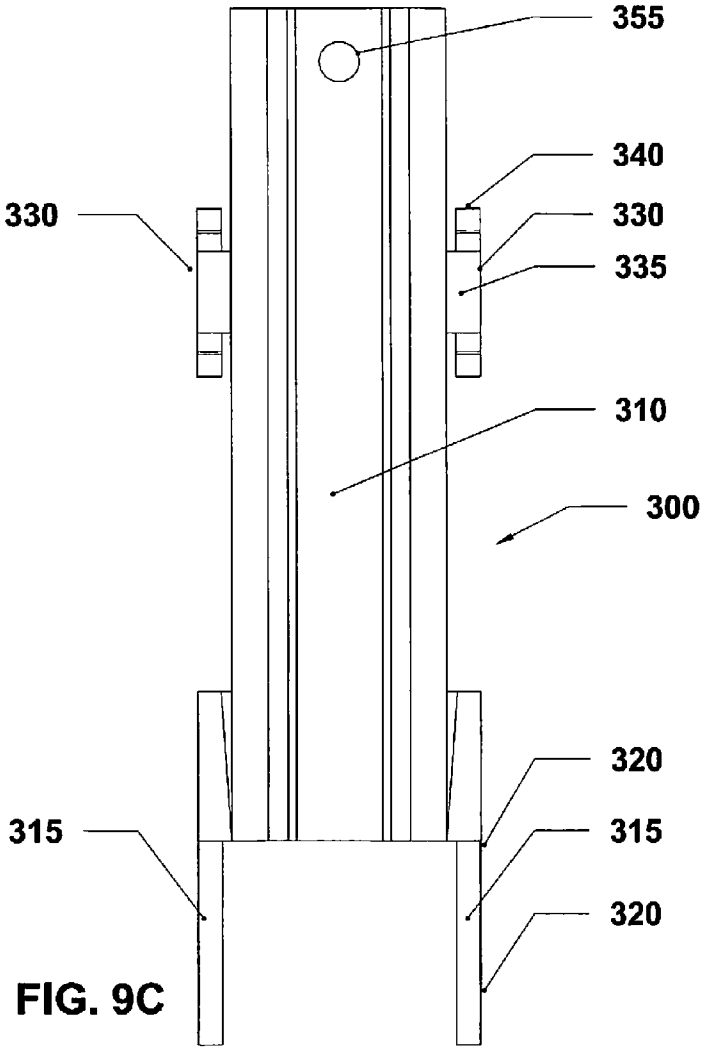
Figure 9D:
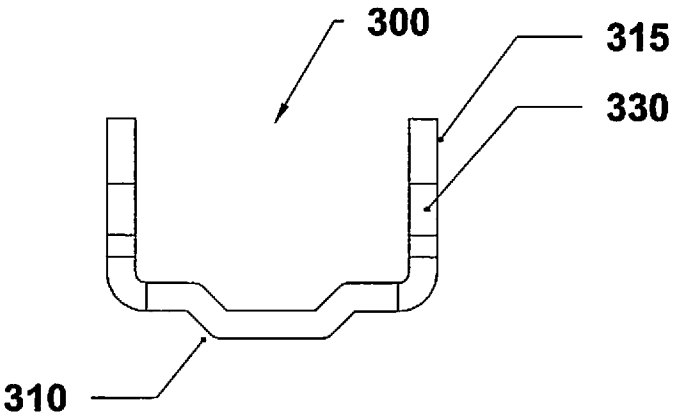

The accessory tray 125 is available for mounting in a complementary fashion with one of the movable panels 120, for holding articles such as chalk, dry-erase markers or erasers, magnets, tacks, or the like. As illustrated particularly in FIG. 8B, the accessory tray 125 is mounted to the lower T-section 165 of the lower mounting rail 100, although it is conceivable that the tray 125 could be mounted to the upper mounting rail 100 as a shelf for holding small articles for display, out of the reach of smaller children. The tray 125 includes a generally horizontal bed 260 (FIG. 8) with an upturned outer edge 265 for retaining articles within the tray. An inner edge 270 of the tray 125 is defined by an upwardly extending backstop 275. The backstop 275 retains articles within the tray and is further of a height to fully cover the opening 181 in the mounting rail 100 behind the tray 125 (see FIG. 8B), to prevent articles from inadvertently entering the C-channel of the mounting rail 100. A downwardly disposed U-channel 280 extends from the inner edge 270 of the tray 125, and is configured for being received on the upwardly extending edge 163 of lower T-section 165 of the mounting rail 100. Once positioned on the lower T-section 165, a preferably non-marring set screw 285 received in a threaded aperture 290 on the exterior leg 295 of the downwardly disposed U-channel 280 of the tray 125 engages the outer face of the lower T-section 165 to secure the tray 125 in position.

A vertical rail member 130 (FIGS. 4 & 10) can be mounted to upper and lower rails 100. The vertical rail member 130 commonly comprises an adjustable shelf standard or pilaster 130. The shelf standard comprises a vertical channel member having a plurality of evenly spaced vertical slots along an outer side configured to receive a complementary shelf bracket. A board is laid upon a pair of such brackets arranged at the same vertical height to form a shelf. The height and number of shelves mounted on the shelf standard is readily adapted by the user.

Figure 10:
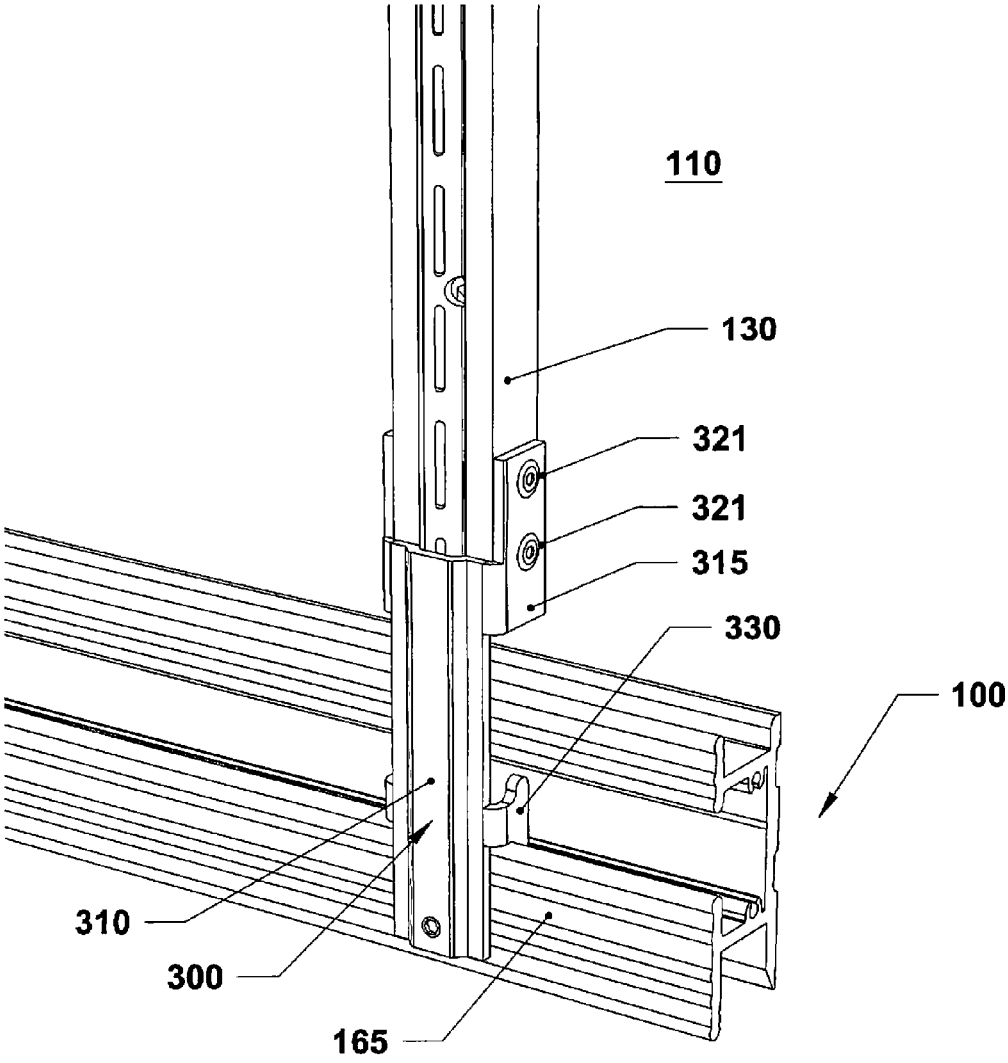
FIG. 10 is a perspective view of a vertical standard mounted on a mounting rail of the present invention.

The vertical rail member 130, such as the shelf standard, can be attached between the mounting rails 100 by a pair of accessory hanging brackets 300 mounted at the upper and lower extents of the vertical rail member 130 and spaced to correspond to the spacing of the upper and lower mounting rails 100. The accessory hanging bracket (FIGS. 9 & 10) includes a central web portion 310 and two accessory mounting flanges 315 arranged to extend perpendicularly from the central web portion for attachment to the member 130. The two accessory mounting flanges 315 extend from the central web portion 310 in parallel, and include apertures 320 for receiving fasteners 321 to secure the member 130. In addition to the accessory mounting flanges 320 attached to the member, two T-flanges 330 extend from the central web portion 310. The T-flanges 330 include a neck portion 335 extending from the central web portion 310, and an enlarged head portion 340. The enlarged head portion 340 is configured to pass between the upper and lower T-shaped rails 155,165 of the mounting rail 100 to occupy the C-shaped channel 180 of the mounting rail 100. Once the enlarged head portion 340 of the T-flange 330 passes into the C-shaped channel 180, the accessory hanging brackets 300 are lowered so that the neck 335 of the T-flange 330 rests on the lower T-section 165 of the rail 100. The enlarged head portion 340 of the T-flange 330 is in position to engage the inner surface of the lower T-section 165 of the mounting rail 100 to prevent the accessory hanging bracket 300 from being removed from the mounting rail 100. A non-marring set screw 350 is threaded through an aperture 355 in the central web portion 310 of the accessory hanging bracket 300 to engage the face of the lower T-section 165 of the mounting rail 100. The head portion 340 of the T-flange 330 is drawn against the inner surface of the lower T-section 165 by the set screw 350 to prevent the accessory hanging bracket 300 from being raised and disengaging the mounting rail 100. In the mounted position, the accessory mounting flanges 315 extend perpendicularly from the central web portion 310, parallel to each other and to the T-flanges 330, and extend substantially the full depth of the mounting rail 100 to support the vertical rail member 130 between the upper and lower mounting rails 100, proximate to the support surface 110 (FIG. 10).

Figure 4:
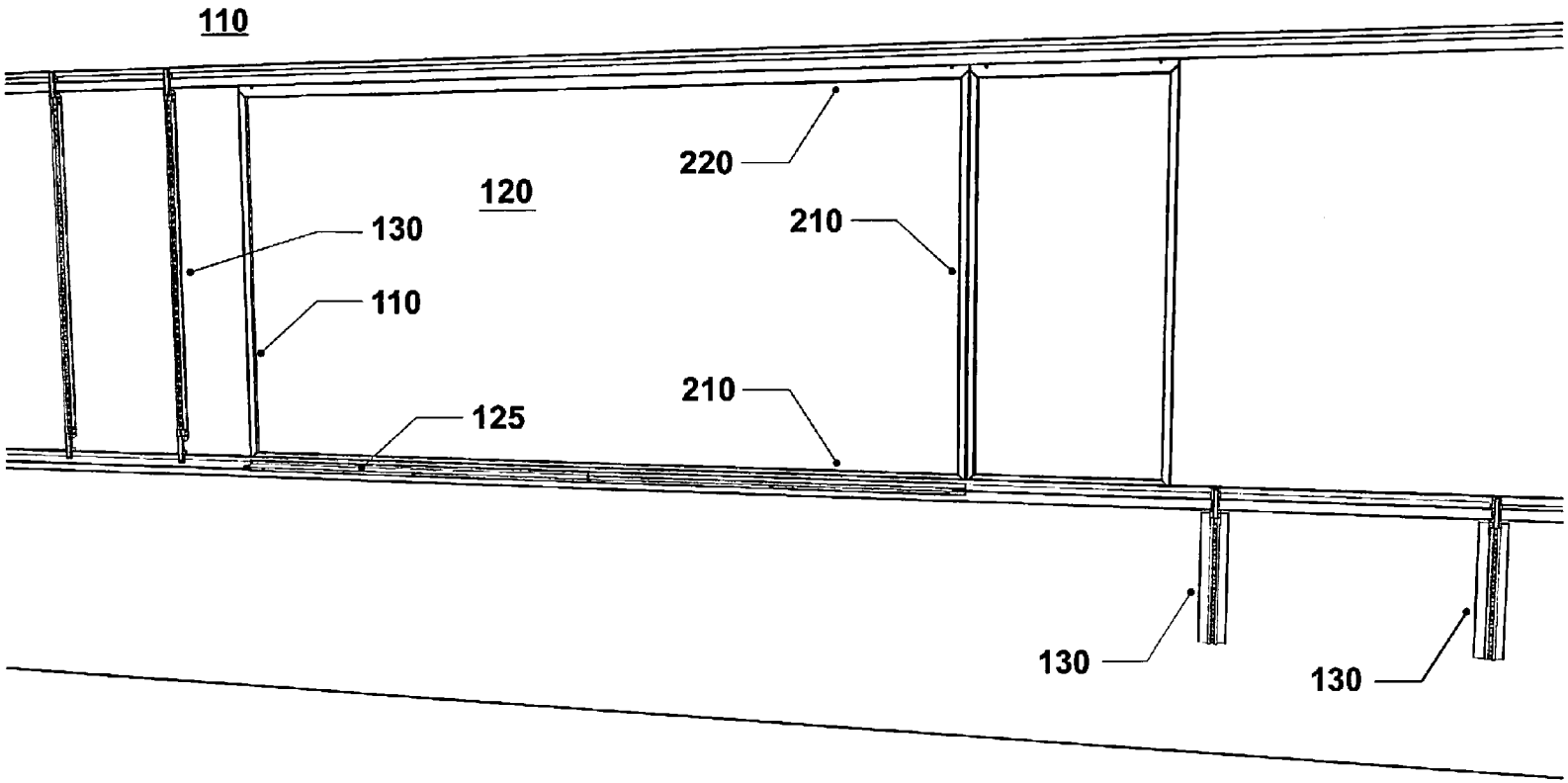
FIG. 4 is a perspective view of a marker board and tack board and lower vertical standards mounted according to the invention.

In addition to being mounted between the upper and lower rails 100, vertical standards can be mounted to the lower rail so as to extend downwardly from the lower rail, as shown by standards 130 in FIG. 4. A lower rail 100 might typically be positioned about 29 inches above the floor. By mounting a standard to the lower rail so as to extend downwardly therefrom, shelves or the like can be placed at lower levels, adding to the storage capabilities of the system and making it possible to have lower shelves or work surfaces for smaller children. This can be accomplished by providing a longer standard that extends from the upper rail downwardly past the lower rail, or a shorter standard that is attached only to the lower rail and extends downwardly.

Figure 11A:
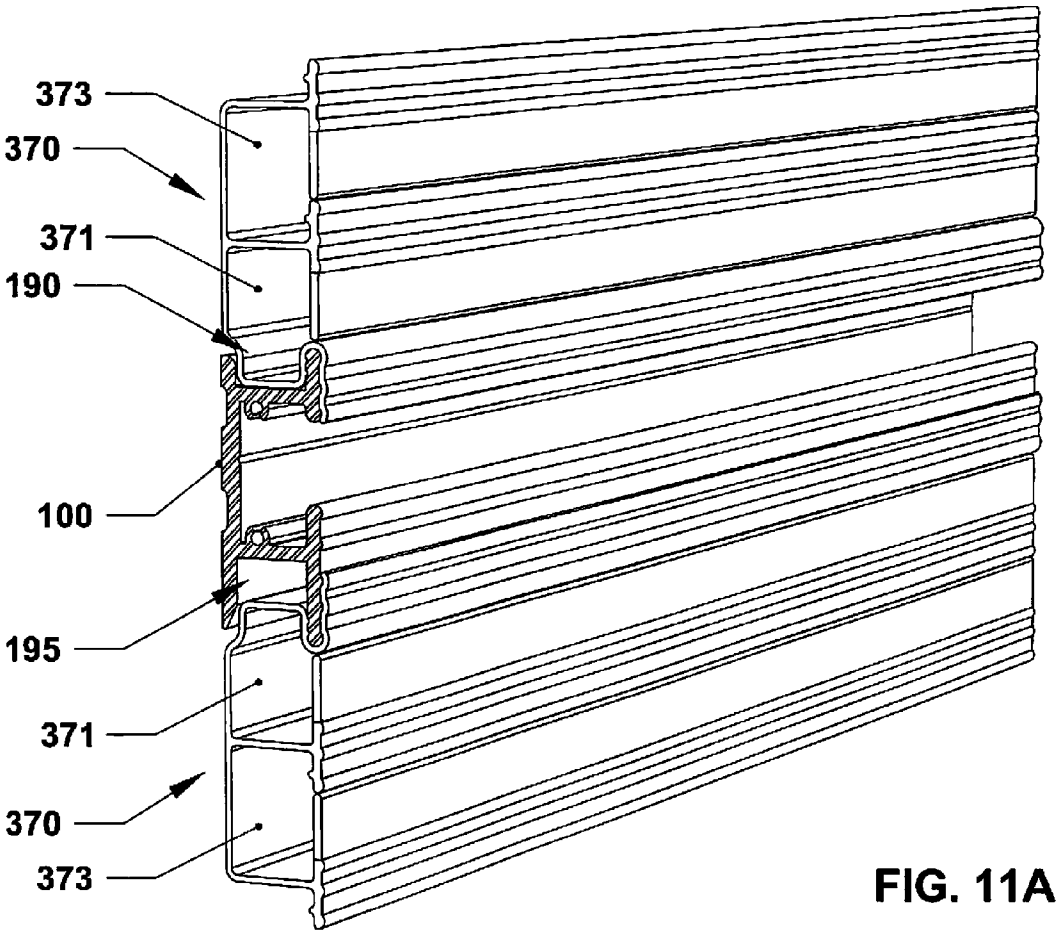
FIG. 11A is a perspective view showing double channel wire management channels affixed to a mounting rail of the present invention.
Figure 11B:
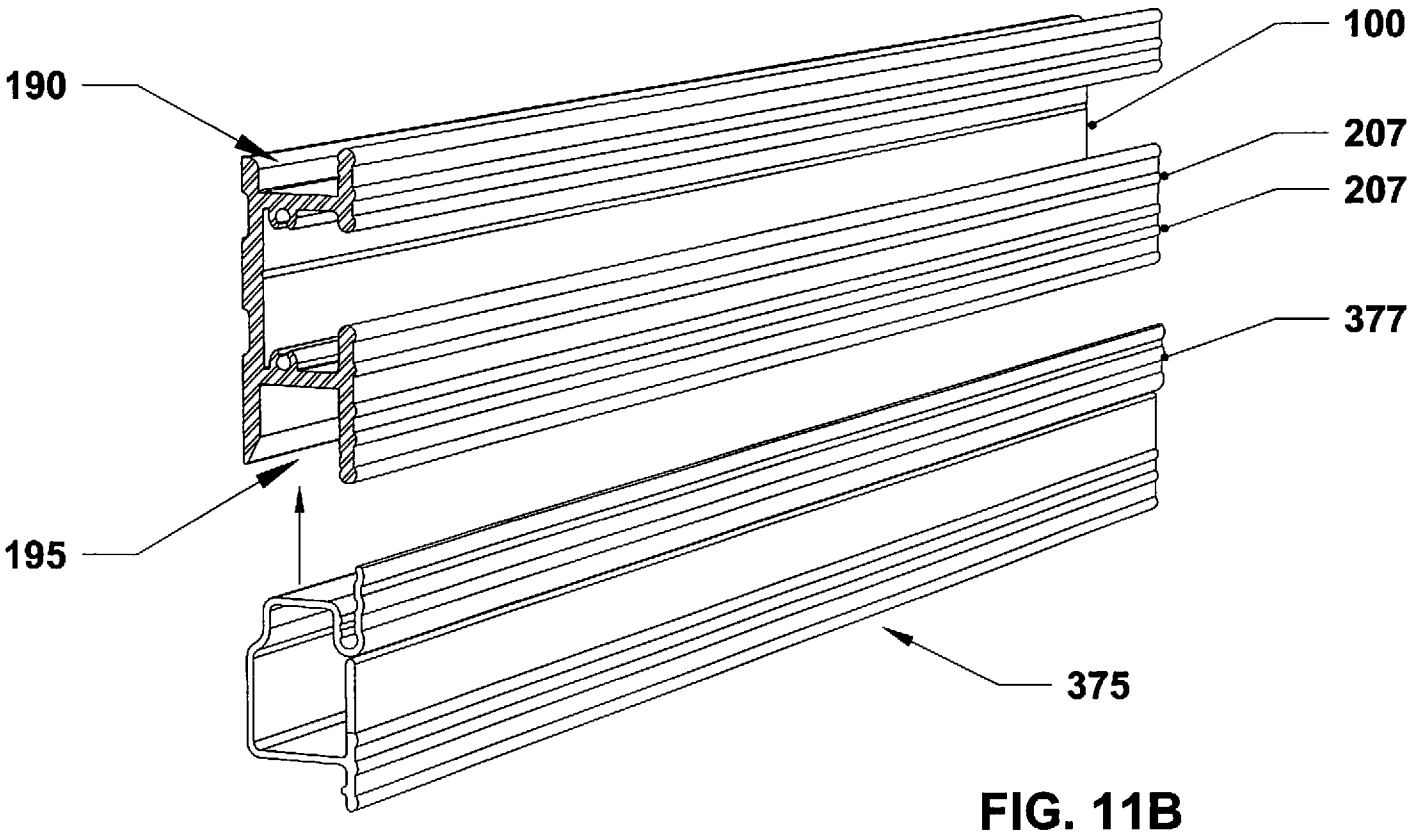
FIGS. 11B and 11C are perspective views of an alternate configuration of the wire management channel wherein a single wire management channel is interconnectable with the top or bottom of the mounting rail and is interconnect able to itself to make a double wire channel.
Figure 11C:
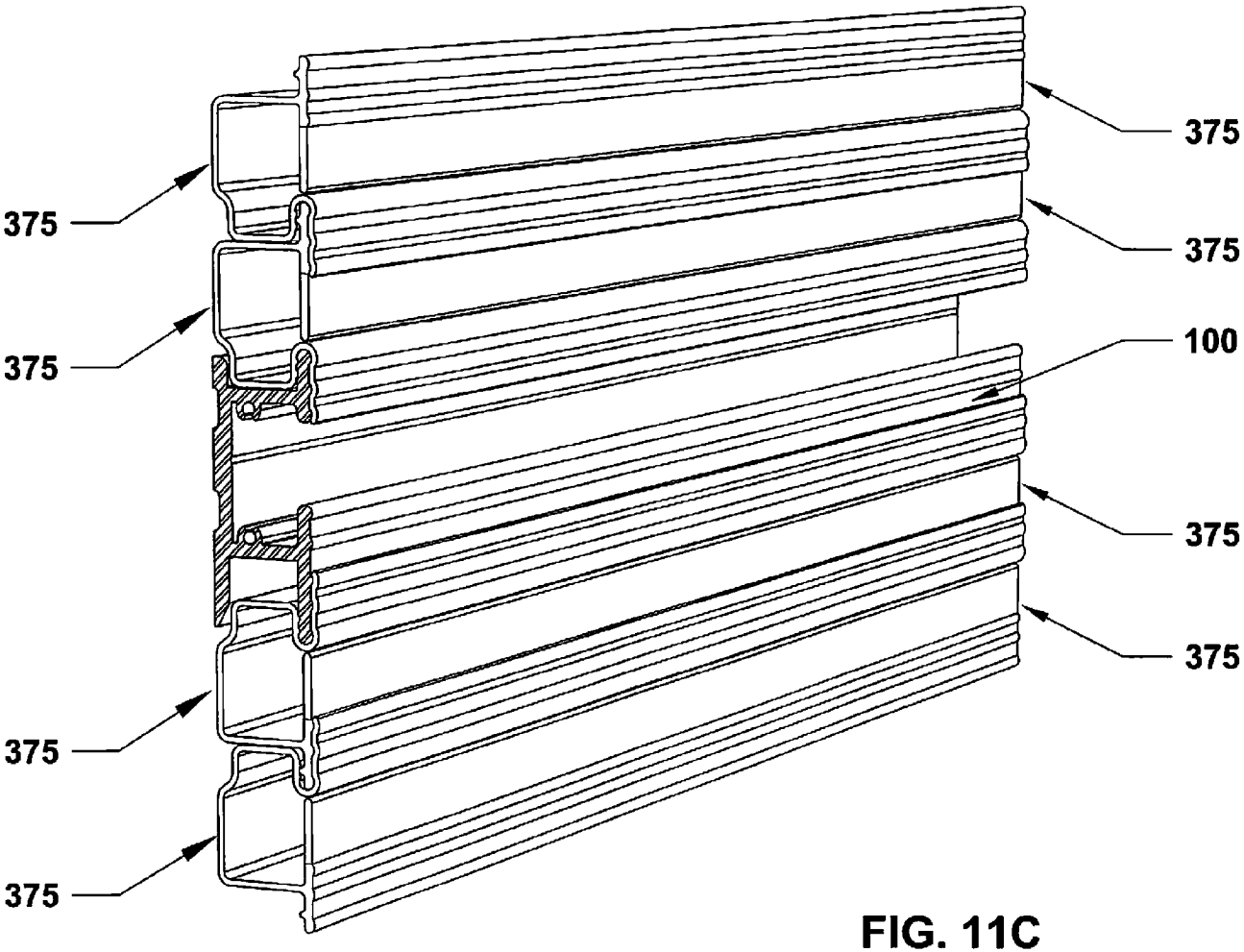

Referring to FIGS. 11A-11C, a wiring or cable channel 370 is selectively attached to one or more of the upwardly and downwardly oriented U-channels 190,195 of the rail 100. The cable channel 370 can have one or multiple cavities 371, 373 for protective wire management within and through the mounting rail. A double cavity cable channel 370 is shown in FIG. 11A. Alternatively, a uniform single channel 375 can be employed and can be formed so that two or more single channels can be clipped together, as shown in FIGS. 11B and 11C. Overall, there generally will be at least two separate channels when both power and communications cables are used, because power and communications cables should be separated. In addition, where the space between the upper and lower mounting rails carries a movable panel, the cable channel 370 can only be mounted to the upwardly oriented U-channel 190 of the upper mounting rail 100 or the downwardly oriented U-channel 195 of the lower mounting rail 100. The wiring channels desirably are formed of a synthetic resin, with resilient, spaced gripping flanges 377 that fit over and grip ridged surfaces 207 on the rails 100. The use of a non-conductive material for the cable channels also limits the possibility of short circuits. A metal shield around communications cables can limit signal interference.

Figure 12A:
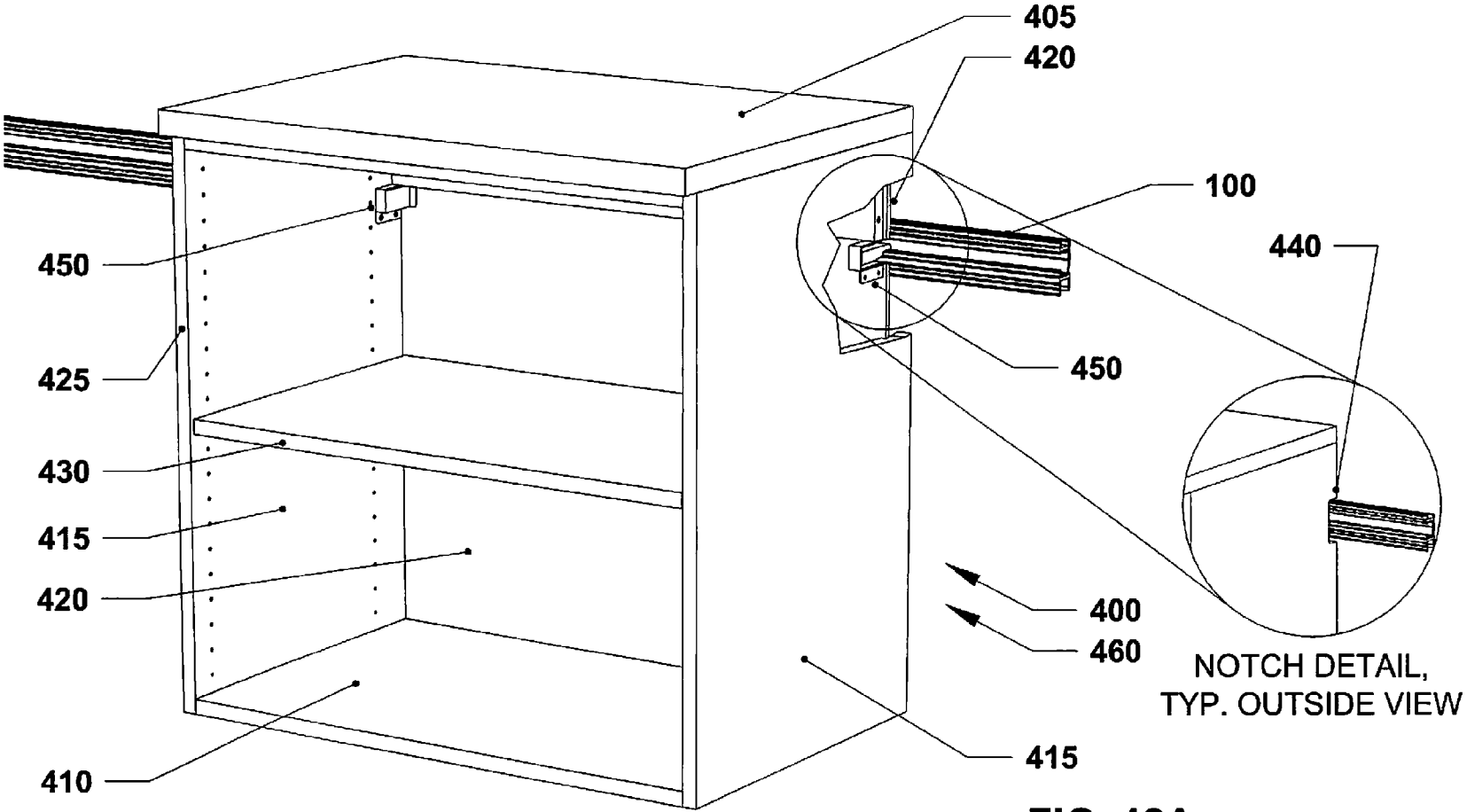
FIG. 12A is a partially cutaway perspective view showing a cabinet suspended from a support rail of the present invention.
Figure 12B:
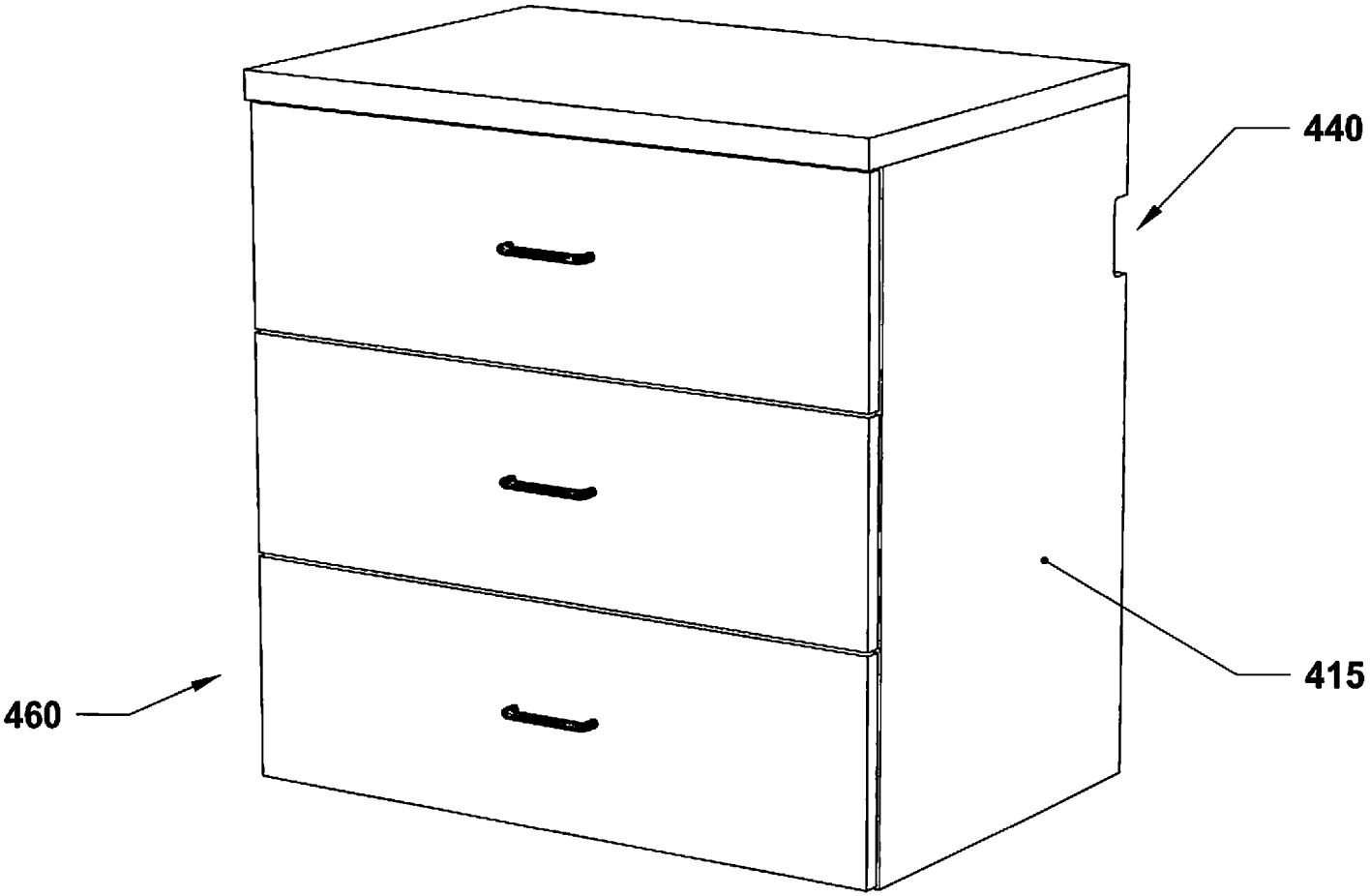
FIGS. 12B-12H are perspective views of alternative cabinets and furniture that are suspended from the support rails.
Figure 12C:
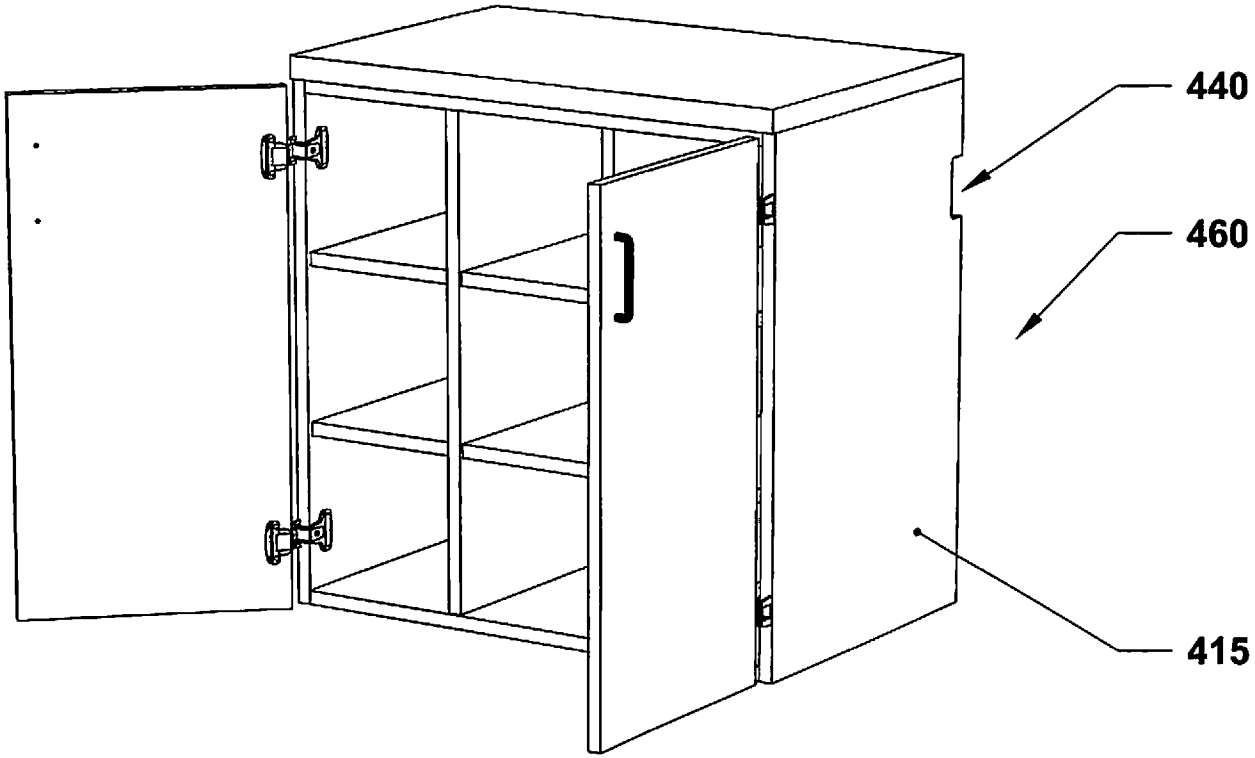
Figure 12D:
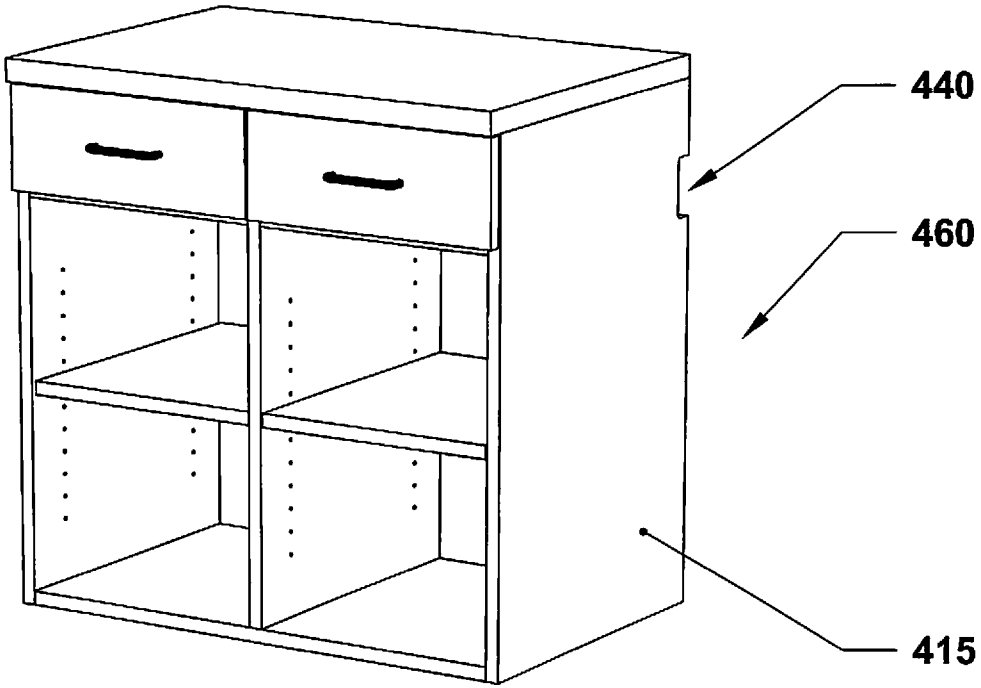

A full range of modular cabinetry (FIG. 1) is adaptable for use with the wall-mounted support rails. A typical cabinet 400 (FIG. 12A) comprises a five-sided box having a top 405, bottom 410, side walls 415, and a back wall 420, with an open front 425. In some instances (not shown), the open front 425 is braced with a frame and the top of the box is left open, to be covered with a countertop. The open front 425 can be adapted to receive doors or drawers, or can be left open for ready access to open shelves 430 contained therein. In the cabinetry adapted for the rail mounting system of the present invention the side walls 415 desirably extend beyond the back wall 420 by a distance corresponding to a depth necessary to accommodate the depth of the mounting rail 100 between the rear edges of the side walls and the back wall of the cabinet. The side walls 415 are then provided with a notch 440 so that the cabinet 400 can be mounted flush to the wall surface 110, with the mounting rail 100 passing through the notch 440 in each respective side wall 415. Because the side wall 415 extends beyond the back wall 420, the rail 100 passes behind the back wall 420, and the integrity of the back wall 420 is not disrupted.

Figure 13:
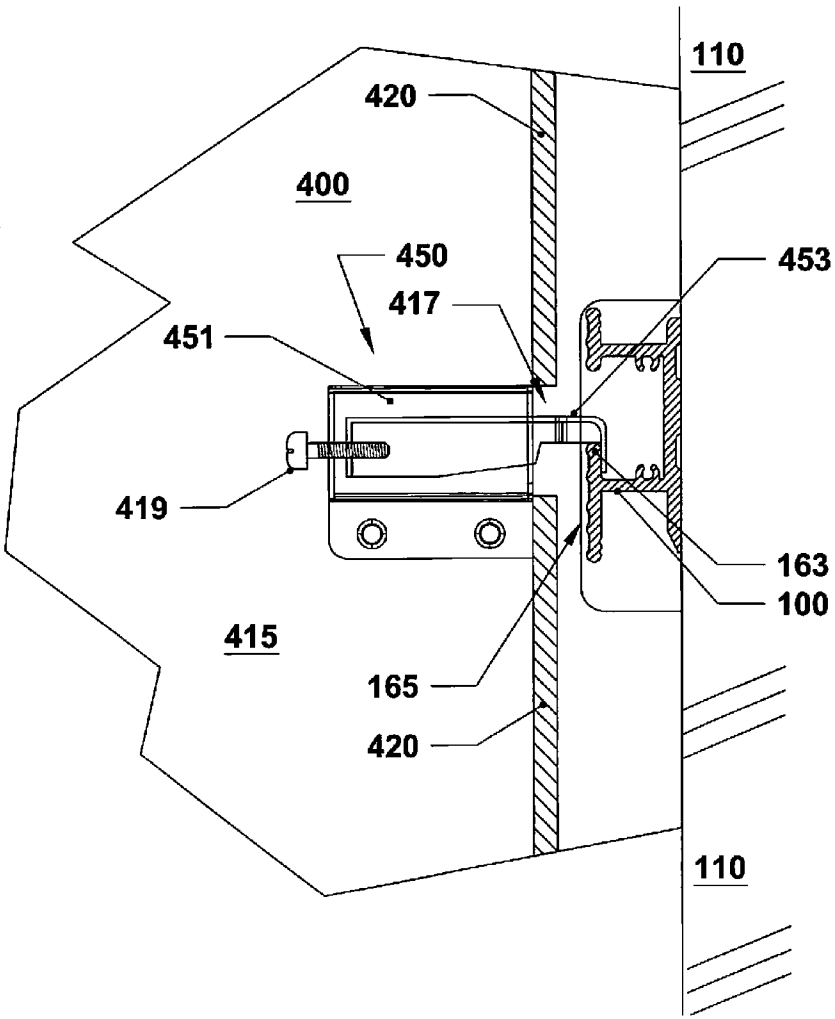
FIG. 13 is a fragmentary side schematic view of the invention showing the manner in which a cabinet is mounted to a rail with a cabinet bracket.

A known latching mechanism 450 (shown schematically in FIG. 13) is provided within each cabinet 400 on the side walls 415, for mounting the cabinet 400 to the rail 100. Each latching mechanism 450 includes a body 451 and an extendible L shaped arm 453 that extends through a small opening 417 in the back wall 420 of the cabinet 400, adjacent to the side wall 415, to engage the mounting rail 100. The L-shaped arm fits over the edge of the mounting rail 100, generally the upper edge 163 of lower T-shaped member 165. A screw mechanism 419 draws the L-shaped arm inwardly and draws the cabinet 400 flush to the vertical wall surface 110.

Figure 12E:
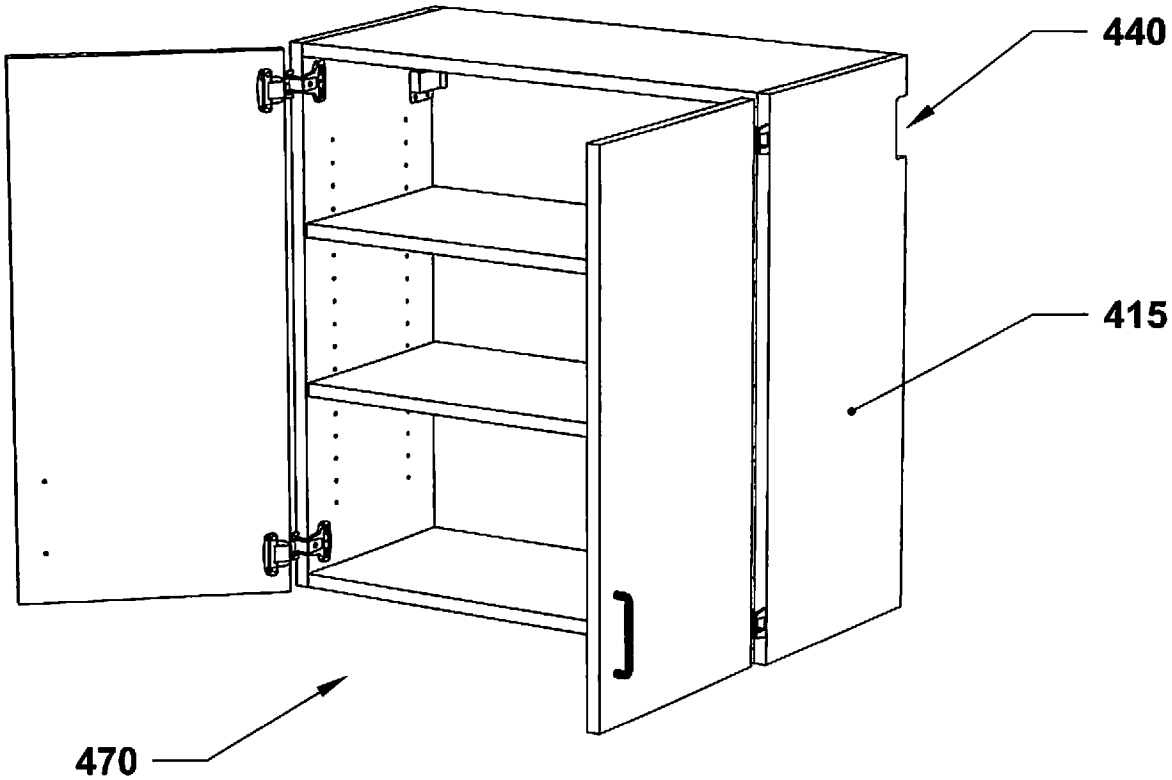
Figure 12F:
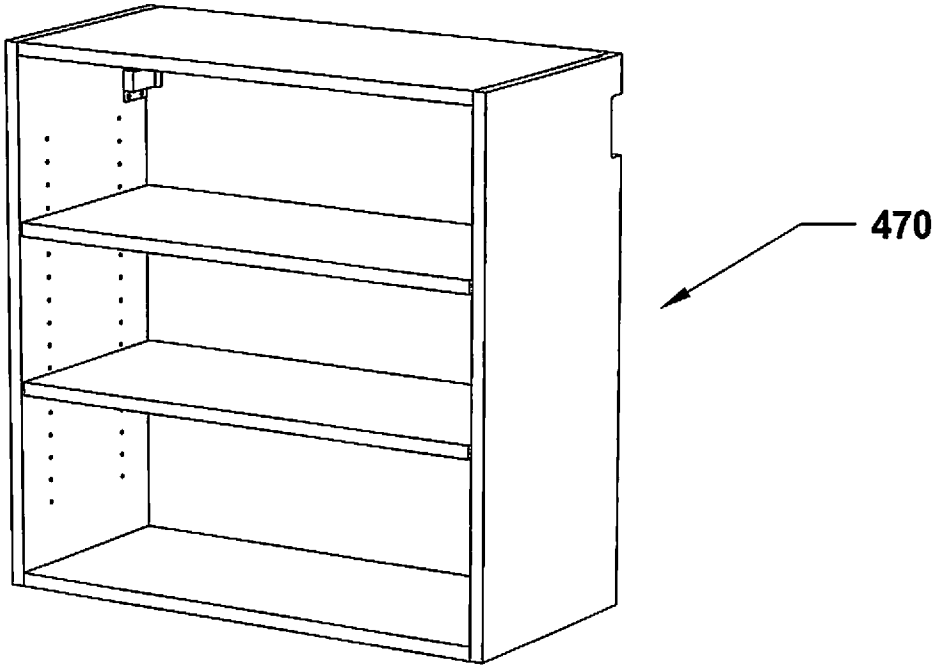
Figure 12G:
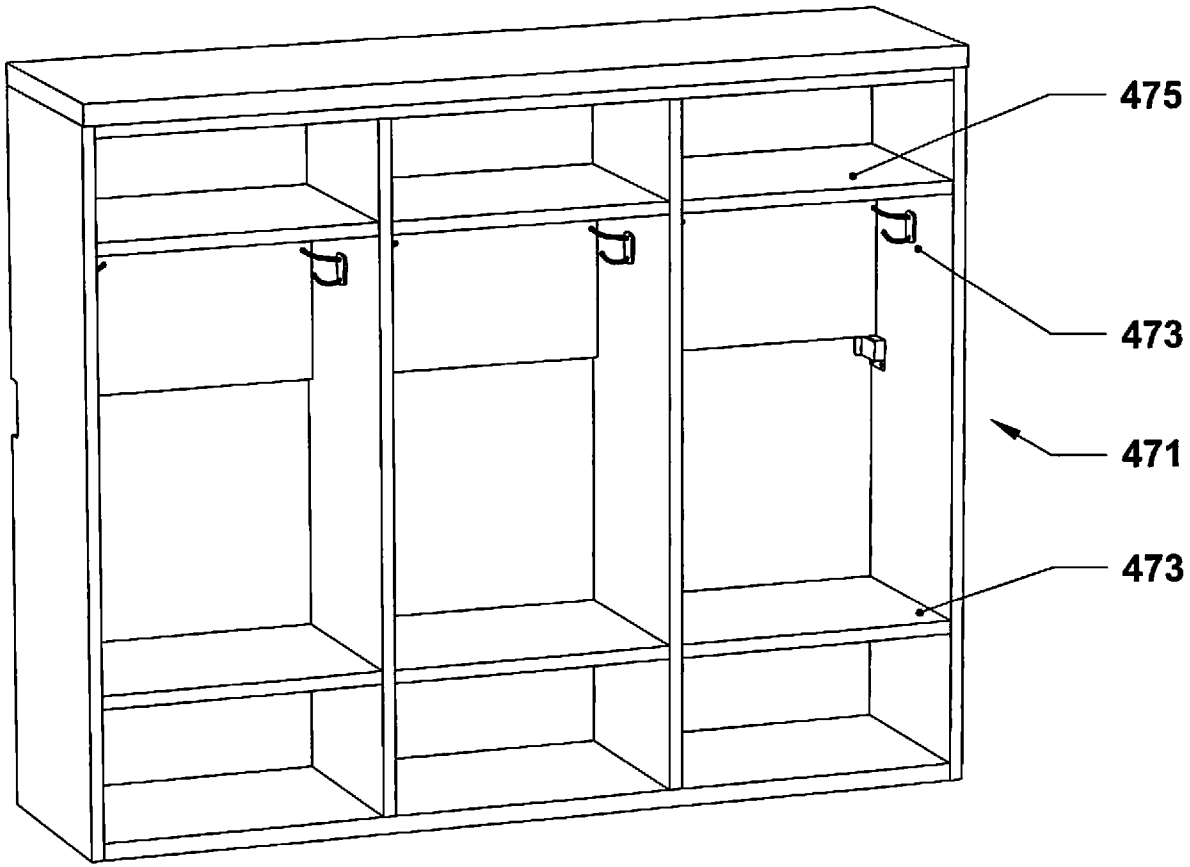
Figure 12H:
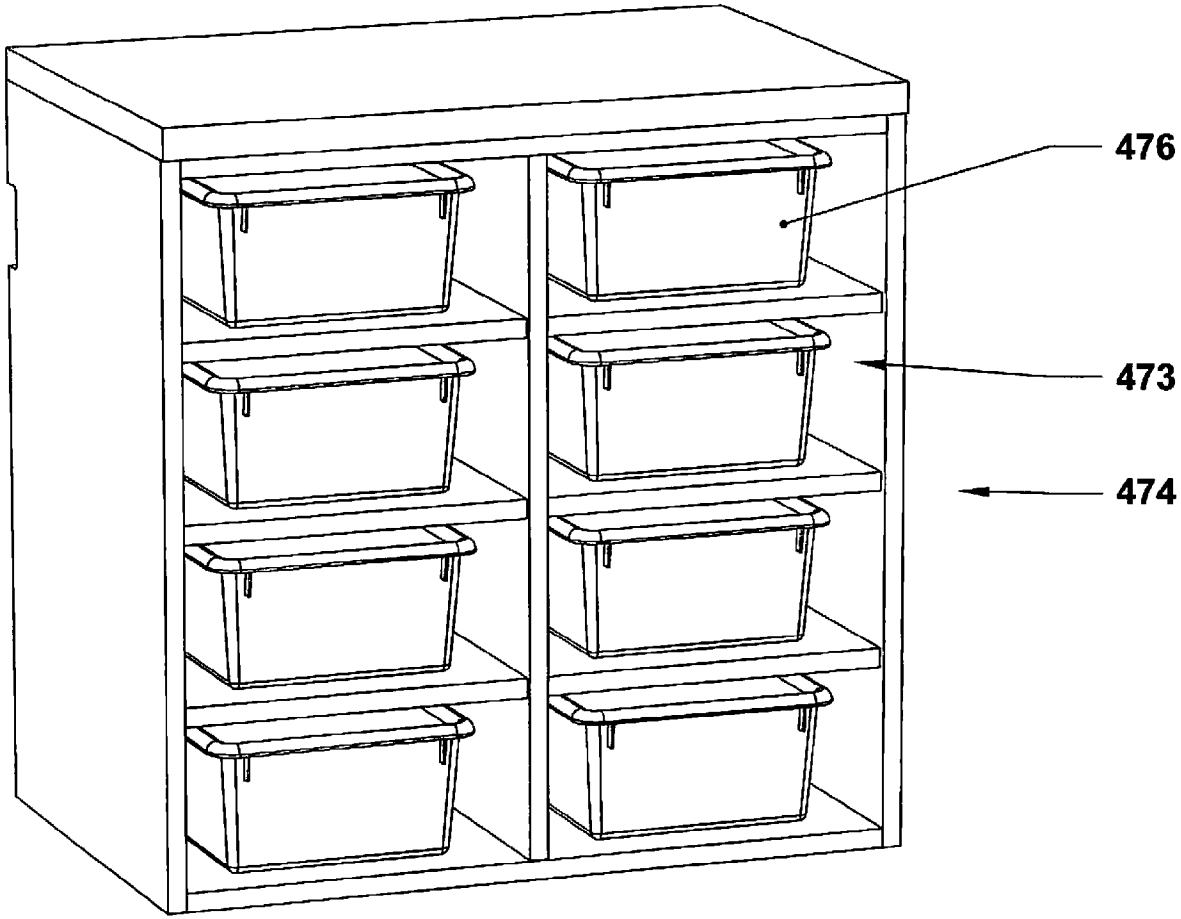

"Base" cabinets 460 are configured to mount to the lower mounting rail 100 at a conventional and uniform height above the floor, while "upper" cabinets 470 are configured to mount to the upper mounting rail 100, usually leaving sufficient clearance for a work space between the base cabinets 460 and the upper cabinets 470. In some cabinet configurations, wherein the cabinet is a full-height wall cabinet 480, such as a large locker-type cabinet or bookcase (FIG. 1A), the cabinet 480 is provided with two sets of aligned latching mechanisms 450 positioned to engage both the upper and lower mounting rails 100 respectively. The side walls 415 of the full-height cabinet are accordingly provided with two sets of corresponding notches 440 to align with the upper and lower mounting rails 100 to facilitate flush mounting to the wall surface 110. A number of different upper cabinets 470 are shown in FIGS. 12E and 12F. A coat locker 471 having coat hooks 483 and shelves 475 is shown in FIG. 12G. A tray cubby unit 474 is shown in FIG. 12H. This includes removable trays or boxes 476 in separate compartments 478. Additional types of cabinets, which are generally referred to as case goods can also be employed in the present invention. Generally, all of the cabinets are mounted so that they are suspended above the floor, the base cabinets preferably being at least about six inches above the floor. This makes it possible to clean, polish and even refinish or re-tile an entire floor without being affected by the present configuration of the case goods and other wall mounted fixtures.

Figure 14A:
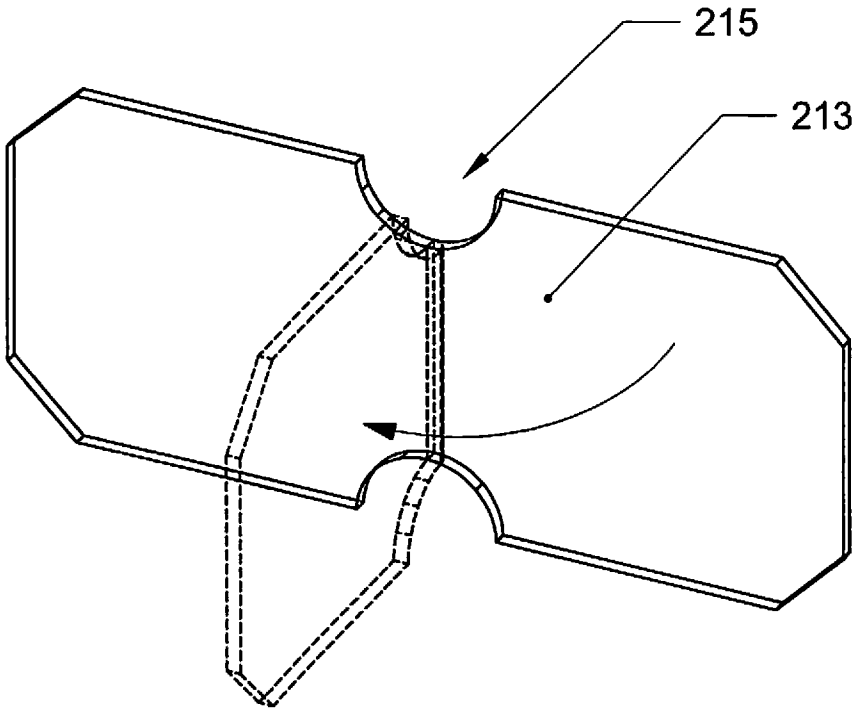
FIG. 14A shows a connector spline track section.
Figure 14B:
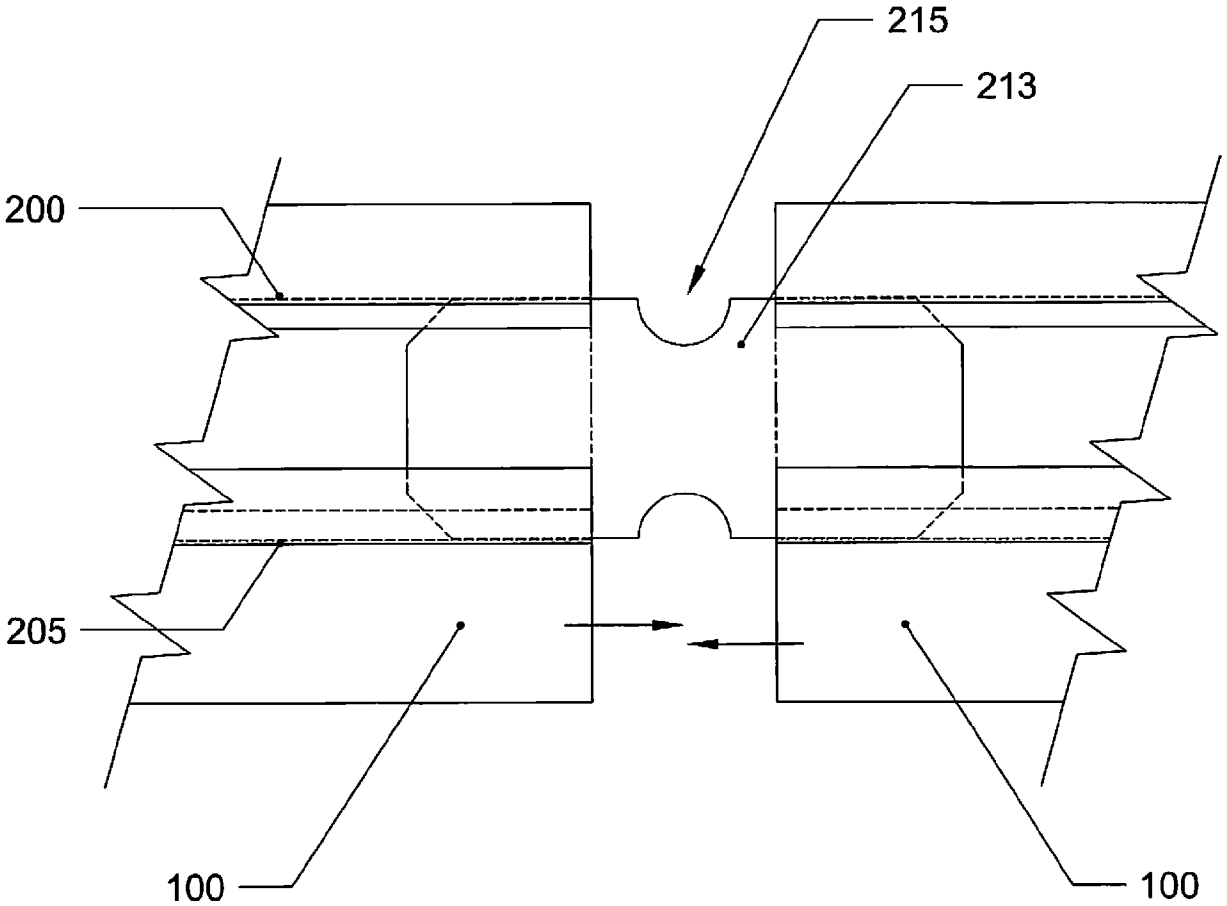
FIGS. 14B and 14C show the manner in which the spline connects the track sections at aligned and corner junctions.
Figure 14C:
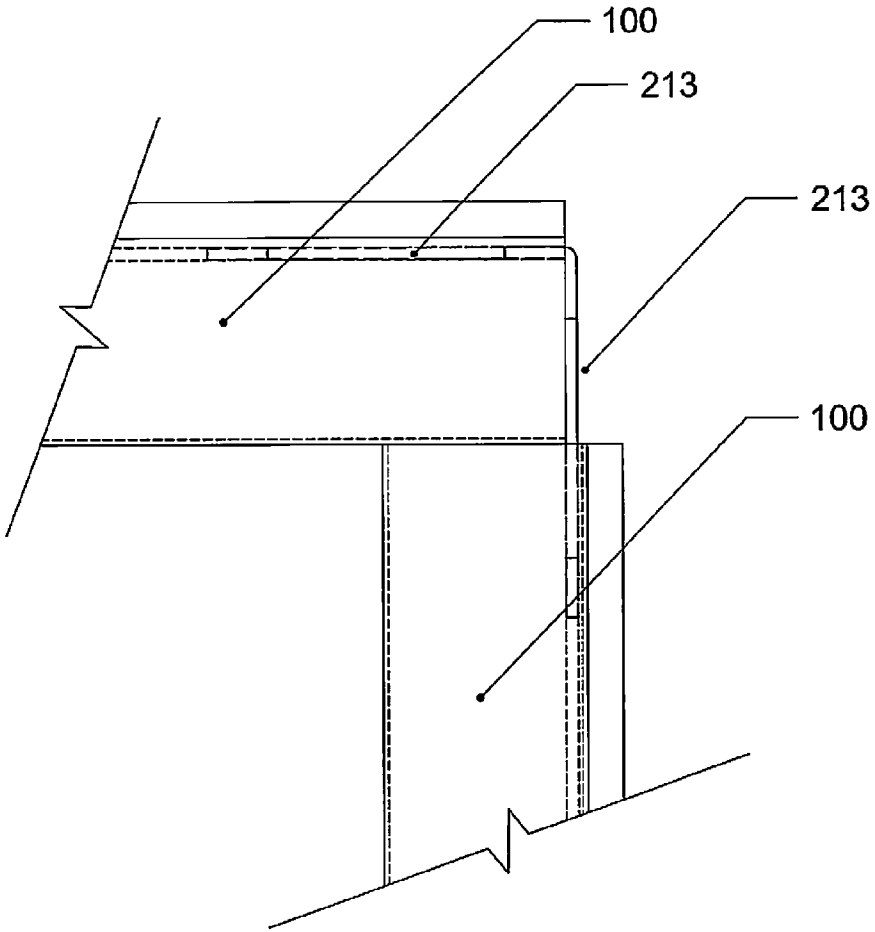

Another feature of the present invention is that adjacent sections of mounting rail 100 can easily be connected together end to end on a wall surface 110 or perpendicularly at a corner. The trim channels 200 and 205 in the rail sections comprise inwardly facing C-shaped interior channels that provide inwardly facing grooves 211 on the upper and lower sides of the C-shaped interior channel of the mounting rail 100 (see FIG. 3). Elongated splines 213 formed of metal or other material that is preferably bendable fit snuggly into these grooves in abutting sections of rail 100. These maintain the proper alignment of the mounting rails 100 while they are attached to a wall. Because both rails 100 are attached to the wall, the splines 213 do not have to be fastened to the mounting rails 100. The splines 213 can have notches 215 at an intermediate position, so that the splines 213 can more easily be bent at the notches for purposes of connecting sections of rail 100 at a corner or other skewed position, as shown in FIGS. 14A and 14C. The splines 213 can be fabricated so that corner sections of mounting rail 100 can be connected by butt joints, as shown in FIG. 14C.

The modular classroom furniture of the present invention is infinitely adaptable to a wide range of changing uses for the classroom, or even just to match a particular layout desired by the educator. More specifically, the arrangement of the modular classroom furniture can be changed on-the-fly without modifying the building structure of the classroom. With the mounting rails secured to the walls of the classroom, each element of the modular classroom furniture can be easily mounted to or removed from the mounting rail with only a screwdriver. Further, the wall mounting system of the present invention is not limited to the traditional classroom environment, but is also adaptable to other learning or work spaces and applications that may require frequent or ready adaptation to changing uses.

The invention claimed is:

1. A modular classroom wall mounting system, comprising:

at least one mounting rail having a profile with a planar wall mounting portion, the wall mounting portion having a substantially flat surface for attachment to a mounting surface and an opposing outwardly facing surface having a chamfered lower edge, an upper T-shaped section extending from the wall-mounting portion and forming with the wall-mounting portion an upper U-shaped channel having a top depth, and a lower T-shaped section extending from the wall mounting portion below the upper T-shaped section, forming with the wall mounting portion a downwardly directed U-shaped channel having a bottom depth, the bottom depth being greater than the top depth, the upper and lower T-shaped sections forming with the wall mounting portion a central C-channel, each of the upper and lower T-shaped sections including an inwardly directed C-shaped trim channel within the central C-channel, each C-shaped trim channel forming a groove with the outwardly facing surface of the wall-mounting portion.

2. The modular classroom wall mounting system of claim 1, wherein the at least one mounting rail comprises an upper mounting rail and a lower mounting rail, mounted to a wall surface in a horizontal orientation with the upper rail mounted above the lower rail.

3. The modular classroom wall mounting system of claim 1, further comprising an accessory tray having a horizontal storage platform, an outer edge of the platform being turned upwardly, and an inner edge of the platform having an upward extension and a downward extension, the downward extension being in the form of a downwardly directed U-shaped channel, the U-shaped channel engaging the lower T-shaped section of the mounting rail, the upward extension abutting an outer face of the upper T-shaped section, and a threaded aperture through an outer leg of the downward extension, a set screw extending through the threaded aperture and engaging an outer face of the lower T-shaped section.

4. The modular wall mounting system of claim 1, wherein the at least one mounting rail comprises an upper mounting rail and a lower mounting rail, and wherein the system further comprises a flat panel accessory having an upper edge and a lower edge, and extending from the lower mounting rail to the upper mounting rail, the upper edge having an "h"-shaped profile with an upwardly extending leg at an outer face of the panel, the upwardly extending leg having at least one upwardly canted threaded aperture therethrough, with a set screw passing through the aperture and engaging the chamfered lower edge of the upper mounting rail.

5. The modular wall mounting system of claim 1, further comprising a vertical rail member connected to the at least one mounting rail by an accessory hanging bracket, the vertical rail member having a plurality of equally spaced elongate slots, the accessory hanging bracket having a center web and opposing parallel accessory mounting flanges, the mounting flanges having apertures, and fasteners extending through the apertures to secure the vertical rail member, the bracket further having a pair of parallel T-flanges on opposing edges of the center web, the T-flanges engaging one of the upper and lower T-sections of the at least one mounting rail.

6. The modular wall mounting system of claim 5, wherein the at least one mounting rail comprises upper and lower mounting rails, and wherein the vertical rail member extends between the upper and lower mounting rails.

7. The modular wall mounting system of claim 5, wherein the vertical rail member extends downwardly from the lower mounting rail.

8. The modular wall mounting system of claim 5, further comprising a threaded aperture in the center web of the accessory mounting bracket and a set screw extending through the threaded aperture and engaging an outer face of the at least one mounting rail.

9. The modular classroom mounting system of claim 1, further comprising an accessory cable channel having a hollow T-shaped portion engaging one of the upper and lower T-shaped sections of the mounting rail, and a hollow box channel portion.

10. The modular classroom mounting system of claim 9, wherein the hollow box channel portion comprises dual hollow channels.

11. The modular classroom mounting system of claim 9, the accessory cable channel further comprising a T-shaped portion, engageable by the hollow T-shaped portion of a second like cable channel for stacking of cable channels.

12. The modular classroom wall mounting system of claim 1, further comprising a cabinet attached to the at least one mounting rail, having top and bottom walls, a back wall, and two sidewalls, the walls secured together and forming an open front box, the top and bottom walls and the side walls having a back edge and a front edge, the back wall secured to the side walls forward of the back edge, the side walls each having a notch in the back edge for receiving the mounting rail, and a latching mechanism engaging the mounting rail and removably securing the cabinet to the mounting rail with the back edges of the side walls against the mounting surface.

13. The modular classroom wall mounting system of claim 12, further comprising shelves selectively mounted on the interior of the cabinet.

14. The modular classroom wall mounting system of claim 12, further comprising doors pivotally mounted to the front edges of the side walls of the cabinet.

15. The modular classroom wall mounting system of claim 12, further comprising drawers slidably mounted within the interior of the cabinet.

16. The modular classroom wall mounting system of claim 1, wherein the at least one mounting rail comprises at least two sections of mounting rail joined end to end on a mounting surface, the at least two sections of mounting rail being aligned by a flat spline member inserted into the groove in each section formed between each C-shaped trim channel and the outwardly facing surface of the wall-mounting portion.

17. The modular classroom wall mounting system of claim 1, wherein the at least one mounting rail comprises at least two sections of mounting rail joined end to end at a corner joining two perpendicular mounting surfaces, the at least two sections of mounting rail being joined by an L-shaped spline member inserted into the groove in each section formed between each C-shaped trim channel and the outwardly facing surface of the wall-mounting portion.

18. A method of providing a modular classroom furnishing system, comprising the steps of:

providing upper and lower mounting rails each having a profile with a planar wall mounting portion, the wall mounting portion having a substantially flat surface and an opposing outwardly facing surface having a chamfered lower edge, an upper T-shaped section extending from the wall-mounting portion and forming with the wall-mounting portion an upper U-shaped channel having a top depth, and a lower T-shaped section extending from the wall mounting portion below the upper T-shaped section, forming with the wall mounting portion a downwardly directed U-shaped channel having a bottom depth, the bottom depth being greater than the top depth, the upper and lower T-shaped sections forming with the wall mounting portion a central C-channel, each of the upper and lower T-shaped sections including an inwardly directed C-shaped trim channel within the central C-channel, each C-shaped trim channel forming a groove with the outer surface of the wall-mounting portion;

mounting the upper and lower mounting rails to a vertical wall surface in a horizontal orientation, the upper mounting rail being mounted a predetermined distance above and parallel to the lower mounting rail;

providing a flat panel accessory having an upper edge and a lower edge, and extending from the lower mounting rail to the upper mounting rail, the upper edge having an "h"-shaped profile with an upwardly extending leg at an outer face of the panel, the upwardly extending leg having at least one upwardly canted threaded aperture therethrough, with a set screw passing through the aperture;

canting the upper edge of the flat panel accessory toward the wall surface and raising the flat panel accessory so the upper edge enters the downwardly directed U-shaped channel of the upper mounting rail, rotating the lower edge of the flat panel accessory toward the wall surface, and lowering the flat panel accessory so that the lower edge rests in the upper U-shaped channel of the lower mounting rail; and engaging the chamfered lower edge of the upper mounting rail with the set screw passing through the aperture in the upwardly extending leg of the upper edge of the flat panel accessory.

19. The method of claim 18, further comprising the steps of:

providing a cabinet having top and bottom walls, a back wall, and two sidewalls, secured together and forming an open front box, the top and bottom walls and the side walls having a back edge and a front edge, the back wall secured to the side walls forward of the back edge, the side walls each having a notch in the back edge for receiving a mounting rail, and a latching mechanism for engaging said mounting rail; and securing the cabinet to at least one of the upper and lower mounting rails with the back edges of the side walls against the vertical wall surface, said mounting rail passing through the notches in the side walls and the latching mechanism engaging the mounting rail to secure the cabinet to the wall surface.

20. A mounting rail for a modular wall mounting system having a profile with a planar wall mounting portion, the wall mounting portion having a substantially flat wall-facing surface and an opposed outwardly facing surface having a chamfered lower edge, an upper T-shaped section extending from the wall-mounting portion and forming with the wall-mounting portion an upper U-shaped channel having a top depth, and a lower T-shaped section extending from the wall mounting portion below the upper T-shaped section, forming with the wall mounting portion a downwardly directed U-shaped channel having a bottom depth, the bottom depth being greater than the top depth, the upper and lower T-shaped sections forming with the wall mounting portion a central C-channel, each of the upper and lower T-shaped sections including an inwardly directed C-shaped trim channel within the central C-channel, each C-shaped trim channel forming a groove with the outwardly facing surface of the wall-mounting portion.

* * * * *